US007569136B2

(12) United States Patent
Ackerson et al.

(10) Patent No.: US 7,569,136 B2
(45) Date of Patent: Aug. 4, 2009

(54) CONTROL SYSTEM METHOD AND APPARATUS FOR TWO PHASE HYDROPROCESSING

(76) Inventors: Michael D. Ackerson, 3241 Nottinghill, Fayetteville, AR (US) 72701; Michael Steven Byars, 721 E. Winbaugh La., Fayetteville, AR (US) 72703

( * ) Notice: Subject to any disclaimer, the term of this patent is extended or adjusted under 35 U.S.C. 154(b) by 534 days.

(21) Appl. No.: 11/089,477

(22) Filed: Mar. 24, 2005

(65) Prior Publication Data

US 2006/0144756 A1 Jul. 6, 2006

Related U.S. Application Data

(63) Continuation-in-part of application No. 11/007,846, filed on Dec. 9, 2004, now Pat. No. 7,291,257, which is a continuation-in-part of application No. 10/162,310, filed on Jun. 3, 2002, now Pat. No. 6,881,326, which is a continuation of application No. 09/599,913, filed on Jun. 22, 2000, now Pat. No. 6,428,686, which is a continuation of application No. 09/104,079, filed on Jun. 24, 1998, now Pat. No. 6,123,835.

(60) Provisional application No. 60/050,599, filed on Jun. 24, 1997.

(51) Int. Cl.
*C10G 47/00* (2006.01)
*C10G 45/02* (2006.01)

(52) U.S. Cl. ..... 208/108; 208/213; 208/251 H; 208/254 H

(58) Field of Classification Search ..... 208/108, 208/213, 251 H, 254 H
See application file for complete search history.

(56) References Cited

U.S. PATENT DOCUMENTS 3,152,981 A 10/1964 Berlin et al.

(Continued)

FOREIGN PATENT DOCUMENTS

EP 0464931 A1 1/1992

(Continued)

OTHER PUBLICATIONS

B.M. Sankey and D.A. Gudelis, 18.3 Lube Oil Extraction, Imperial Research Dept. Canada, No date.

(Continued)

*Primary Examiner*—Glenn Caldarola
*Assistant Examiner*—Prem C. Singh
(74) *Attorney, Agent, or Firm*—Brandi N. Waters; Grady K. Bergen

(57) ABSTRACT

A continuous liquid phase hydroprocessing process, apparatus and process control systems, where the need to circulate hydrogen gas through the catalyst is eliminated. By mixing and/or flashing the hydrogen and the oil to be treated in the presence of a solvent or diluent in which the hydrogen solubility is high relative to the oil feed, all of the hydrogen required in the hydroprocessing reactions may be available in solution. The oil/diluent/hydrogen solution can then be fed to a plug flow reactor packed with catalyst where the oil and hydrogen react. No additional hydrogen is required; therefore, the large trickle bed reactors can be replaced by much smaller tubular reactors. The amount of hydrogen added to the reactor can be used to control the liquid level in the reactor or the pressure in the reactor.

32 Claims, 19 Drawing Sheets

U.S. PATENT DOCUMENTS

| | | | |
|---|---|---|---|
| 3,730,880 | A | 5/1973 | Van der Toorn et al. |
| 3,880,598 | A | 4/1975 | Van der Toorn et al. |
| 3,958,957 | A | 5/1976 | Koh et al. |
| 4,011,884 | A | 3/1977 | Drori |
| 4,030,521 | A | 6/1977 | Karlsson |
| 4,047,655 | A | 9/1977 | McCafferty |
| 4,404,809 | A | 9/1983 | Johnson et al. |
| 4,491,511 | A | 1/1985 | Skinner et al. |
| 4,514,282 | A | 4/1985 | Poynor et al. |
| 4,536,275 | A | 8/1985 | Bronfenbrenner et al. |
| 4,585,546 | A | 4/1986 | Bowes et al. |
| 4,591,426 | A | 5/1986 | Krasuk et al. |
| 4,663,028 | A | 5/1987 | Ditman |
| 4,678,556 | A | 7/1987 | Hicks et al. |
| 4,698,147 | A | 10/1987 | McConaghy, Jr. |
| 4,715,398 | A | 12/1987 | Shouldice et al. |
| 4,761,513 | A | 8/1988 | Steacy |
| 4,772,157 | A | 9/1988 | Obermeyer |
| 4,844,117 | A | 7/1989 | Sung |
| 4,853,104 | A | 8/1989 | Degnan, Jr. et al. |
| 4,857,168 | A | 8/1989 | Kubo et al. |
| 4,880,449 | A | 11/1989 | Babyak |
| 4,909,927 | A | 3/1990 | Bell |
| 4,911,821 | A | 3/1990 | Katzer et al. |
| 4,917,135 | A | 4/1990 | Duncan |
| 4,944,863 | A | 7/1990 | Smith et al. |
| 4,968,409 | A | 11/1990 | Smith |
| 4,970,190 | A | 11/1990 | Lopez et al. |
| 4,995,961 | A | 2/1991 | Hays et al. |
| 5,009,770 | A | 4/1991 | Miller et al. |
| 5,013,424 | A | 5/1991 | James, Jr. et al. |
| 5,021,142 | A | 6/1991 | Bortz et al. |
| 5,024,750 | A | 6/1991 | Sughrue, II et al. |
| 5,035,793 | A | 7/1991 | Nebesh et al. |
| 5,068,025 | A | 11/1991 | Bhan |
| 5,071,540 | A | 12/1991 | Culross et al. |
| 5,098,452 | A | 3/1992 | Feller |
| 5,110,445 | A | 5/1992 | Chen et al. |
| 5,110,450 | A | 5/1992 | Culross et al. |
| 5,120,426 | A | 6/1992 | Johnston et al. |
| 5,132,007 | A | 7/1992 | Meyer et al. |
| 5,164,074 | A | 11/1992 | Houghton |
| 5,178,750 | A | 1/1993 | Mead |
| 5,183,556 | A | 2/1993 | Reilly et al. |
| 5,196,116 | A | 3/1993 | Ackerson et al. |
| 5,198,103 | A | 3/1993 | Meyer et al. |
| 5,200,063 | A | 4/1993 | Neskora et al. |
| 5,227,552 | A | 7/1993 | Chang et al. |
| 5,240,592 | A | 8/1993 | Meyer et al. |
| 5,269,910 | A | 12/1993 | Matsumura et al. |
| 5,312,543 | A | 5/1994 | Taylor et al. |
| 5,336,395 | A | 8/1994 | Pabst et al. |
| 5,379,795 | A | 1/1995 | Hartley et al. |
| 5,395,511 | A | 3/1995 | Kubo et al. |
| 5,474,668 | A | 12/1995 | Ackerson et al. |
| 5,496,464 | A | 3/1996 | Piskorz et al. |
| 5,589,057 | A | 12/1996 | Trimble et al. |
| 5,620,588 | A | 4/1997 | Ackerson et al. |
| 5,655,232 | A | 8/1997 | Buckwalter |
| 5,671,603 | A | 9/1997 | McCorkle et al. |
| 5,705,052 | A | 1/1998 | Gupta |
| 5,741,414 | A | 4/1998 | Waku et al. |
| 5,744,025 | A | 4/1998 | Boon et al. |
| 5,820,749 | A | 10/1998 | Haluska et al. |
| 5,827,421 | A | 10/1998 | Sherwood, Jr. |
| 5,856,261 | A | 1/1999 | Culross et al. |
| 5,868,921 | A | 2/1999 | Barre et al. |
| 5,881,753 | A | 3/1999 | Bowling |
| 5,906,731 | A | 5/1999 | Abdo et al. |
| 5,925,239 | A | 7/1999 | Klein et al. |
| 5,928,499 | A | 7/1999 | Sherwood, Jr. et al. |
| 5,935,416 | A | 8/1999 | Cody et al. |
| 5,954,945 | A | 9/1999 | Cayton et al. |
| 5,958,218 | A | 9/1999 | Hunter et al. |
| 5,958,220 | A | 9/1999 | Reynolds et al. |
| 5,968,348 | A | 10/1999 | Sherwood, Jr. |
| 5,972,202 | A | 10/1999 | Benham et al. |
| 5,976,353 | A | 11/1999 | Cody et al. |
| 6,017,443 | A | 1/2000 | Buchanan |
| 6,299,759 | B1 | 10/2001 | Bradway et al. |
| 6,311,711 | B1 | 11/2001 | Skoglund |
| 6,689,273 | B1 | 2/2004 | Kalnes et al. |
| 7,300,567 | B2 | 11/2007 | Breivik et al. |

FOREIGN PATENT DOCUMENTS

| | | | |
|---|---|---|---|
| EP | 699733 | A1 | 3/1995 |
| FR | 785974 | | 5/1935 |
| FR | 954644 | A | 2/1991 |
| GB | 934907 | | 7/1961 |
| GB | 1232173 | | 11/1969 |
| GB | 1407794 | | 10/1971 |
| GB | 1346265 | | 2/1974 |

OTHER PUBLICATIONS

J.D. Bushnell and R.J. Fiocco, Engineering Aspects of the Exol N Lube Extraction Process, New Technology in Lube Oil Manufacturing, pp. 159-167. No date.

L.C. Kemp, Jr., G.B. Hamilton and H.H. Gross, Furfural as a Selective Solvent in Petroleum Refining, Industrial and Engineering Chemistry, Feb. 1948, pp. 220-227, vol. 40, No date.

CONTROL SYSTEM METHOD AND APPARATUS FOR TWO PHASE HYDROPROCESSING

FIELD OF INVENTION

This invention relates to a process, apparatus, and method of control for a hydroprocessing process where the reactants are held predominately in the liquid state and it is no longer necessary to circulate hydrogen throughout the catalyst. Relevant prior art may be found in U.S. Class 208, subclasses 58, 59, 60, 79, 209, and 213. Additional relevant art may be found in U.S. Class 137, subclasses 171, 202, and 392, as well as other classes and subclasses.

BACKGROUND OF THE INVENTION

The present invention is directed to a continuous liquid phase hydroprocessing process, apparatus and process control systems, wherein the need to circulate hydrogen gas through the catalyst is eliminated. This is accomplished by mixing and/or flashing the hydrogen and the oil to be treated in the presence of a solvent or diluent in which the hydrogen solubility is high relative to the oil feed. The present invention is also directed to hydrocracking, hydroisomerization and hydrodemetalization.

In hydroprocessing, which includes hydrotreating, hydrofinishing, hydrorefining and hydrocracking, a catalyst is used for reacting hydrogen with a petroleum fraction, distillates, resids, or other chemicals, for the purpose of saturating or removing sulfur, nitrogen, oxygen, metals or other contaminants, or for molecular weight reduction (cracking). Catalysts having special surface properties are required in order to provide the necessary activity to accomplish the desired reaction(s).

In conventional hydroprocessing it is necessary to transfer hydrogen from a vapor phase into the liquid phase where it will be available to react with a petroleum molecule at the surface of the catalyst. This is accomplished by circulating very large volumes of hydrogen gas and the oil through a catalyst bed. The oil and the hydrogen flow through the bed and the hydrogen is absorbed into a thin film of oil that is distributed over the catalyst. Because the amount of hydrogen required can be large, 1000 to 5000 SCF/bbl of liquid, the reactors are very large and can operate at severe conditions, from a few hundred psi to as much as 5000 psi, and temperatures from around 400° F.-900° F.

The temperature inside the reactor is difficult to control in conventional systems. The temperature of the oil and hydrogen feed in the reactor can be controlled; however, once the feed is inside the reactor, there no adjustments to the system that can raise or lower the temperature of the oil/hydrogen mixture. Any changes in the reactor temperature must be accomplished through an outside source. As a result, conventional systems often inject cold hydrogen into the reactor if it becomes too hot. This method of cooling a reactor is expensive and is a potential safety risk.

While controlling the temperature of the reactor is often a difficult task in conventional systems, controlling the pressure of the hydroprocessing system is a much easier task. Pressure control systems are used to monitor the pressure of the system, release pressure through a valve if the pressure becomes too great, and to increase the pressure of the system if the pressure becomes too low. A pressure control system cannot be used to control the pressure on a single hydroprocessing reactor; however, this is of no serious consequence and instead pressure is maintained on the entire system, not on individual reactors.

One of the biggest problems with hydroprocessing is catalyst coking. Coking occurs when hydrocarbon molecules become too hot in an environment where the amount of hydrogen available is insufficient. The molecule cracks to the point that it forms coke, a carbonaceous residue. Cracking can take place on the surface of the catalyst, leading to coke formation and deactivation of the catalyst.

A conventional system for processing is shown in U.S. Pat. No. 4,698,147, issued to McConaghy, Jr. on Oct. 6, 1987, which discloses a SHORT RESIDENCE TIME HYDROGEN DONOR DILUENT CRACKING PROCESS. McConaghy '147 mixes the input flow with a donor diluent to supply the hydrogen for the cracking process. After the cracking process, the mixture is separated into product and spent diluent, and the spent diluent is regenerated by partial hydrogenation and returned to the input flow for the cracking step. Note that McConaghy '147 substantially changes the chemical nature of the donor diluent during the process in order to release the hydrogen necessary for cracking. Also, the McConaghy '147 process is limited by upper temperature restraints due to coil coking, and increased light gas production, which sets an economically imposed limit on the maximum cracking temperature of the process.

U.S. Pat. No. 4,857,168, issued to Kubo et al. on Aug. 15, 1989, discloses a METHOD FOR HYDROCRACKING HEAVY FRACTION OIL. Kubo '168 uses both a donor diluent and hydrogen gas to supply the hydrogen for the catalyst enhanced cracking process. Kubo '168 discloses that a proper supply of heavy fraction oil, donor solvent, hydrogen gas, and catalyst will limit the formation of coke on the catalyst, and the coke formation may be substantially or completely eliminated. Kubo '168 requires a cracking reactor with catalyst and a separate hydrogenating reactor with catalyst. Kubo '168 also relies on the breakdown of the donor diluent for supply hydrogen in the reaction process.

U.S. Pat. No. 5,164,074, issued to Houghton on Nov. 17, 1992, shows a HYDRODESULFURIZATION PRESSURE CONTROL apparatus for controlling pressure in a combination hydrodesulfurization and reforming process wherein the pressure of a hydrogen-rich gas source from the reforming process is adjusted by coordinately manipulating a vent control valve for the reforming process in a manner that insures maximum utilization of available hydrogen for desulfurization before any of the hydrogen from the reforming process is vented through its own vent valve.

U.S. Pat. No. 4,761,513, issued to Steacy on Aug. 2, 1988, shows a TEMPERATURE CONTROL FOR AROMATIC ALKYLATION PROCESS. The temperature control is a quench system that uses a methylating agent as a quench medium that is introduced between sequential reaction zones in a reactor. The proportion of vapor phase and liquid phase methanol is adjusted to control the enthalpy of the methylating agent and provide temperature reduction by the vaporization of the liquid component of the methylating agent.

BRIEF SUMMARY OF THE INVENTION

In accordance with the present invention, a process has been developed wherein the need to circulate hydrogen gas through the catalyst is eliminated. This is accomplished by mixing and/or flashing the hydrogen and the oil to be treated in the presence of a solvent or diluent in which the hydrogen solubility is "high" relative to the oil feed, in a constant pressure environment, so that the hydrogen is in solution.

The type and amount of diluent added, as well as the reactor conditions can be set so that all of the hydrogen required in the hydroprocessing reactions is available in solution. The oil/diluent/hydrogen solution can then be fed to a reactor, such as a plug flow or tubular reactor, packed with catalyst where the oil and hydrogen react. No additional hydrogen is required, therefore, the hydrogen recirculation is avoided and the trickle bed operation of the reactor is avoided. Therefore, the large trickle bed reactors can be replaced by much smaller reactors (see FIGS. 1, 2 and 3). The continuous liquid phase reactors provide more control over the reactor temperature, virtually eliminate catalyst coking, reduce light end hydrocarbon production and can make the system safer.

The present invention is also directed to hydrocracking, hydroisomerization, hydrodemetalization, and the like. As described above, hydrogen gas is mixed and/or flashed together with the feedstock and a diluent, such as recycled hydrocracked product, isomerized product, or recycled demetaled product, so as to place hydrogen in solution, and then the mixture is passed over a catalyst.

A principle object of the present invention is the provision of an improved continuous liquid phase hydroprocessing system, process, method, and/or apparatus.

Another object of the present invention is the provision of an improved hydrocracking, hydroisomerization, Fischer-Tropsch and/or hydrodemetalization process.

Another object of the present invention is the provision of a control method for a reactor in a continuous liquid phase hydroprocessing system, process, method or apparatus.

Another object of the present invention is the provision of an improved apparatus for controlling a continuous liquid phase hydroprocessing system, process, method and/or apparatus.

Another object of the present invention is the provision of a liquid level control method for a reactor in a continuous liquid phase hydroprocessing system, process, method or apparatus.

Another object of the present invention is the provision of a pressure control method for the vapor phase inside a reactor for a continuous liquid phase hydroprocessing system, process, method or apparatus.

Another object of the present invention is the provision of an improved continuous liquid phase hydroprocessing system, process, method, and/or apparatus wherein the liquid may flow into the reactor from either the top of the reactor or the bottom of the reactor.

Another object of the present invention is the provision of an improved continuous liquid phase hydroprocessing system, process, method, and/or apparatus wherein the design of the system may feature a single reactor, multiple reactors, and/or multiple bed reactors.

Another object of the present invention is the provision of reducing light end hydrocarbons in a continuous liquid phase hydroprocessing system by venting excess gas at a constant rate directly from the top of the reactor.

DETAILED DESCRIPTION

We have developed a process where the need to circulate hydrogen gas or have a separate hydrogen phase through the catalyst is eliminated. This is accomplished by mixing and/or flashing the hydrogen and the oil to be treated in the presence of a solvent or diluent having a relatively high solubility for hydrogen, in a constant pressure environment, so that the hydrogen in is solution. Excess hydrogen is mixed and/or flashed into the oil/diluent solution so that the maximum capacity of the oil/diluent solution for hydrogen is utilized. Hydrogen in excess of the amount soluble in the oil/diluent solution remains in the vapor phase.

The type and amount of diluent added, as well as the reactor conditions, can be set so that all of the hydrogen required in the hydroprocessing reaction is available in solution. The oil/diluent/hydrogen solution can then be fed to a plug flow, tubular or other reactor packed with catalyst where the oil and hydrogen react. No additional hydrogen is required, therefore, hydrogen recirculation is avoided and the trickle bed operation of the reactor is avoided (see FIGS. 1, 2 and 3).

Figure 18:
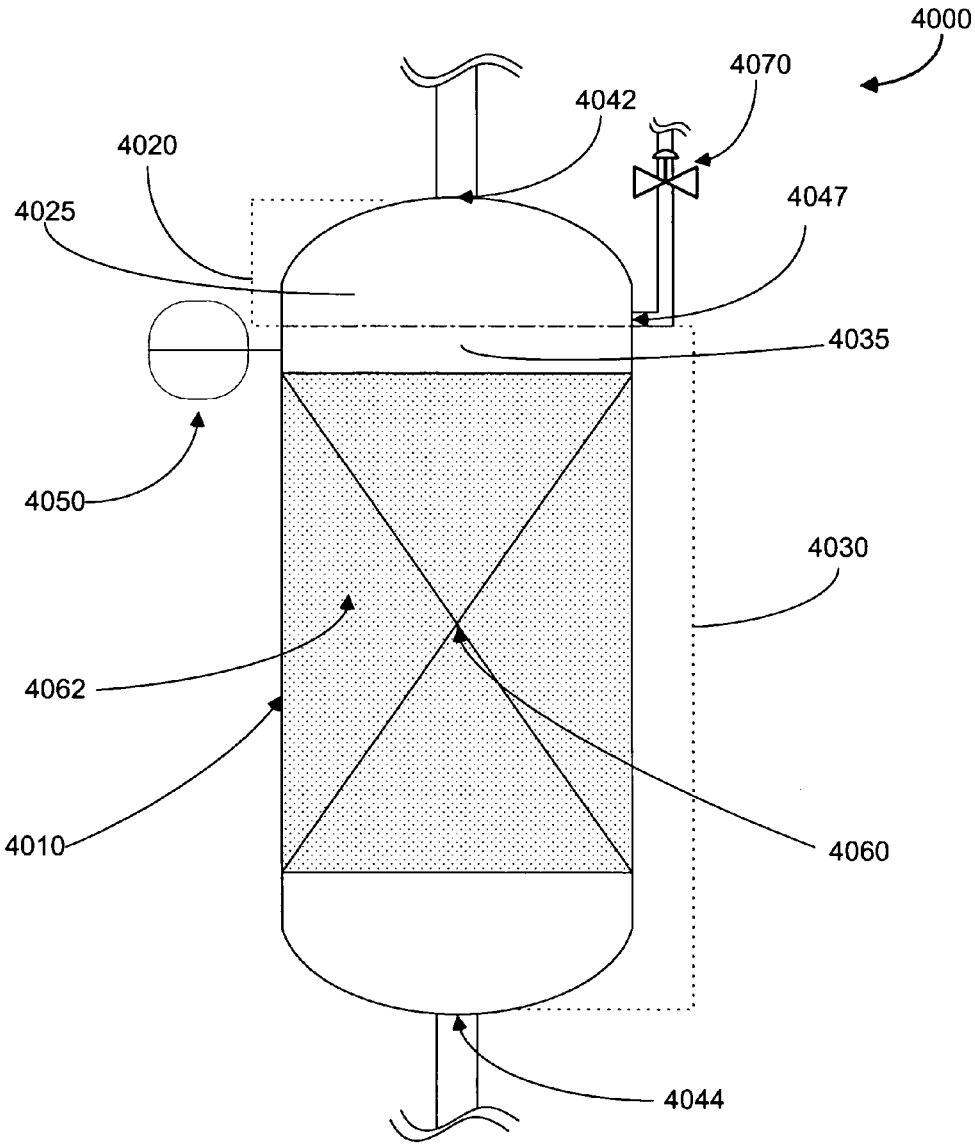
FIG. 18 is a schematic of a single bed, down flow reactor with a liquid level controller for use in a continuous liquid phase hydroprocessing process.

Hence, the large trickle bed reactors can be replaced by much smaller or simpler reactors (see FIG. 18).

In addition to using much smaller or simpler reactors, the use of a hydrogen recycle compressor is avoided. Because all of the hydrogen required for the reaction may be available in solution ahead of the reactor, there is no need to circulate hydrogen gas within the reactor and no need for the recycle compressor. Elimination of the recycle compressor and the use of, for example plug flow or tubular reactors, greatly reduces the capital cost of the hydrotreating process.

The reactors in the present invention may be altered in design and in number to accommodate the specifications required of the product, given a specific feed. To achieve the desired product specifications from a particularly contaminated feed may necessitate the addition of an additional reactor. Even in the case where multiple reactors are required, the reactors of the present invention are preferred to conventional reactors because their smaller size and more simple design still results in a reduction of capital cost when compared to conventional systems. In addition to utilizing multiple reactors, it is also possible to house multiple catalyst beds within a single reactor housing. The creation of multiple-bed reactors (see FIG. 19) further lowers capital cost by utilizing a single reactor vessel to house multiple catalyst beds. The catalyst beds may contain the same catalyst type, or they may contain different catalyst types to more efficiently accomplish the product specification goal.

Most of the reactions that take place in hydroprocessing are highly exothermic, and as a result, a great deal of heat is generated in the reactor. The temperature of the reactor can be controlled by using a recycle stream. A controlled volume of reactor effluent can be recycled back to the front of the reactor, using a reheater as necessary, and blended with fresh feed and hydrogen. The recycle stream absorbs heat created by the reaction of the feed and hydrogen on the catalyst and reduces the temperature rise through the reactor. The reactor temperature can be controlled by controlling the fresh feed temperature, using a preheater as necessary, and the amount of recycle. In addition, because the recycle stream contains molecules that have already reacted, it also serves as an inert diluent. The present invention provides further control of the temperature of the reactor through the use of a continuous liquid phase reactor, as opposed to the conventional trickle bed reactors where only a thin film of liquid is distributed over the catalyst. The advantage of a continuous liquid phase reactor is that liquids, in general, have higher heat capacities than gases. The greater the heat capacity of a given molecule, the greater ability that molecule has for absorbing heat from its surroundings while undergoing a minimal increase in temperature itself. A continuous liquid phase reactor acts as a heat sink, absorbing excess heat from the reactor to equalize the temperature throughout. With the introduction of the continuous liquid phase reactor, the process becomes much closer to being isothermal, reducing a typical 40° F.-60° F. temperature difference between the reactor inlet and reactor outlet to approximately a 10° F. temperature difference. In addition to reducing the temperature difference between the reactor inlet and reactor outlet temperatures, the continuous liquid phase reactor also serves to greatly reduce the problem of hot spots developing within the catalyst bed.

Using the present invention for hydroprocessing, coking can be nearly eliminated because there is always enough hydrogen available in solution to avoid coking when cracking reactions take place. This can lead to much longer catalyst life and reduced operating and maintenance costs.

Another problem found in hydroprocessing is the production of light end hydrocarbon gases. These molecules, predominately methane, are an undesirable product which, in great enough quantities, must be recovered, at additional cost. These light ends increase in quantity as the temperature of the reaction goes up. The problem of light end production is further compounded by the tendency for a reactor to develop hot spots, areas where the temperature increases significantly above the set temperature for the reactor. To combat this occurrence, conventional hydroprocessing systems employ the use of quench boxes which are placed throughout the reactor. The quench boxes serve to inject cold hydrogen into the reactor to reduce the temperature inside the reactor. Not only is hydrogen an expensive choice for cooling the reactor, it can pose a safety hazard. The design of the quench boxes and the method of controlling how they introduce hydrogen into the reactor are vital, because an error could cause the loss of control of the entire system. A runaway reaction could be started, possibly creating an explosion. Using the present invention for hydroprocessing, cracking is greatly reduced, often by a 10-fold reduction, through the use of a continuous liquid phase reactor working also as a heat sink to create a reactor environment that is close to isothermal. This near isothermal environment eliminates the need for cold hydrogen quench boxes, reduces the capital cost of hydrogen required for the process and increases the safety of the system.

With the introduction of a continuous liquid phase reactor, there is a need to be able to control the temperature of the liquid in the reactor and thus, the heat sink which allows the system to remain close to isothermal. By controlling the amount of recycle fluid and the temperature of the fresh feed, it is possible to control the temperature of the liquid in the reactor, and maintain the heat sink, without the need for hydrogen quench boxes.

Another issue that arises with the introduction of a continuous liquid phase reactor is the need for a process for controlling the quantity of that liquid. This is accomplished by one of two ways. First, the quantity of liquid in the reactor can be controlled by maintaining the liquid in the reactor to a specified level (See FIGS. 6, 8, 10, 12, 14 and 16). In this process, there is a specified liquid level range within the reactor which must be maintained. If the level of the liquid rises too high, the amount of hydrogen in the oil/diluent/hydrogen mixture going into reactor will be increased to lower the liquid level. If the level of the liquid drops too low, the amount of hydrogen in the oil/diluent/hydrogen mixture going into the reactor will be decreased to allow more liquid to enter the reactor. In the second control process, the quantity of liquid in the reactor can be controlled by maintaining the pressure of the gases inside the reactor (See FIGS. 7, 9, 11, 13, 15 and 17). The excess hydrogen and light end hydrocarbon gases inside the reactor are held to a specified pressure. If the pressure of those gases becomes too great, the amount of hydrogen in the oil/diluent/hydrogen mixture introduced into the reactor will be decreased to achieve optimal pressure. If the pressure drops too low, the amount of hydrogen in the oil/diluent/hydrogen mixture will be increased. In a hydroprocessing system where multiple reactors or multiple bed reactors are used, the quantity of liquid in the reactors or, in the case of a multiple bed reactor, surrounding the catalyst beds, can be controlled by the exclusive utilization of either multiple liquid level controls or multiple vapor pressure controls of the gases in the upper portion of the reactor, or the two control methods may be combined, in various combinations, within the same system.

The present invention also differs from conventional technology in that excess gas can be vented directly from the reactor. In conventional hydrotreating, the venting of gases directly from the reactor is not possible because hydrogen gas must be circulated through the reactor. If gas were to be vented directly from conventional reactors, a great deal of hydrogen would be lost or used inefficiently. Because the present invention utilizes a continuous liquid phase reactor, it is not necessary to circulate hydrogen through the reactor, and therefore, the only gases inside the reactor are excess hydrogen and light end hydrocarbon gases. Venting excess gas directly from the reactor allows more efficient control of the system by minimizing the time needed for the system to adjust after changes are made to the vent gas flow rate or the addition of hydrogen to or subtraction of hydrogen from the system.

Figure 1:
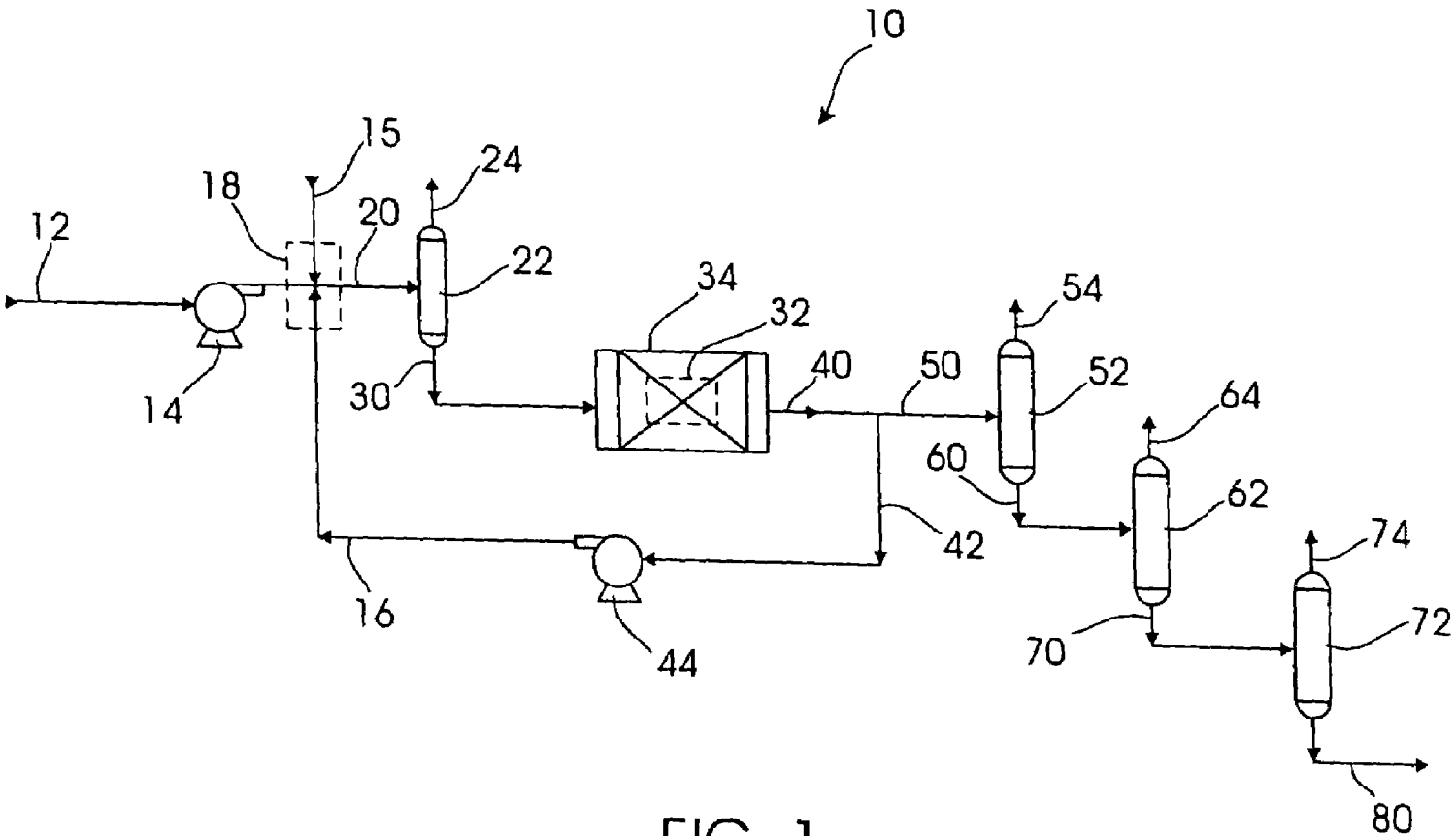
FIG. 1 is a schematic process flow diagram of a diesel hydrotreater.

FIG. 1 shows a schematic process flow diagram for a diesel hydrotreater generally designated by the numeral 10. Fresh feed stock 12 is pumped by feed charge pump 14 to combination area 18. The fresh feed stock 12 is pumped by feed charge pump 14 to combination area 18. The fresh feed stock 12 is then combined with hydrogen 15 and hydrotreated feed 16 to form fresh feed mixture 20. Mixture 20 is then separated in separator 22 to form first separator waste gases 24 and separated mixture 30. Separated mixture 30 is combined with catalyst 32 in reactor 34 to form reacted mixture 40. The reacted mixture 40 is split into two product flows, recycle flow 42 and continuing flow 50. Recycle flow is pumped by recycle pump 44 to become the hydrotreated feed 16 which is combined with the fresh feed 12 and hydrogen 15.

Continuing flow 50 flows into separator 52 where second separator waste gases 54 are removed to create the reacted separated flow 60. Reacted separated flow 60 then flows into flasher 62 to form flasher waste gases 64 and reacted separated flashed flow 70. The reacted separated flashed flow 70 is then pumped into stripped 72 where stripper waste gases 74 are removed to form the output product 80.

Figure 2:
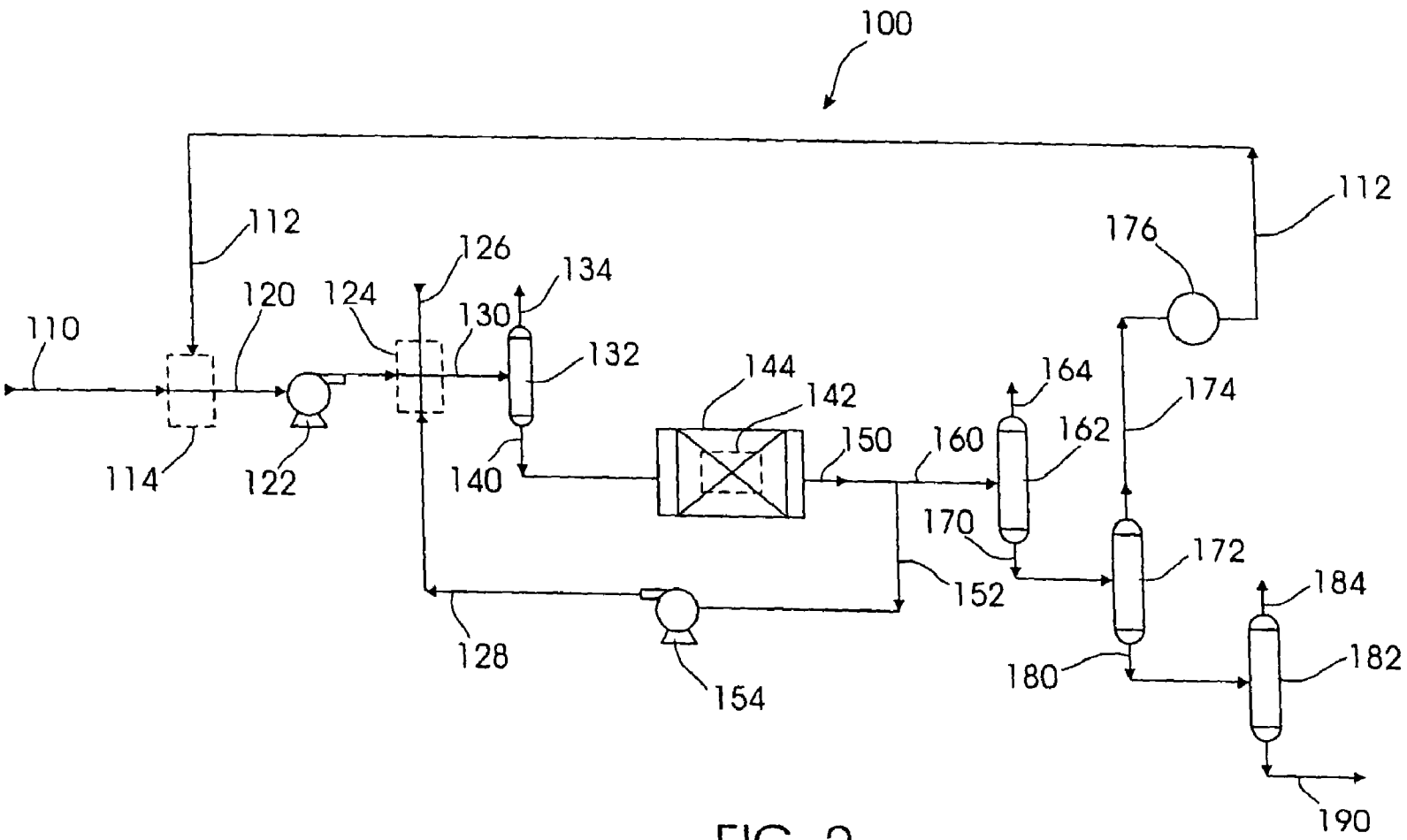
FIG. 2 is a schematic process flow diagram of a resid hydrotreater.

FIG. 2 shows a schematic process flow diagram for a resid hydrotreater generally designated by the numeral 100. Fresh feed stock 110 is combined with solvent 112 at combination area 114 to form combined solvent-feed charge pump 122 to combination area 124. The combined solvent-feed 120 is then combined with hydrogen 126 and hydrotreated feed 128 to form hydrogen-solvent-feed mixture 130. Hydrogen-solvent-feed mixture 130 is then separated in first separator 132 to form first separator waste gases 134 and separated mixture 140. Separated mixture 140 is combined with catalyst 142 in reactor 144 to form reacted mixture 150. The reacted mixture 150 is split into two product flows, recycle flow 152 and continuing flow 160. Recycle flow 152 is pumped by recycle pump 154 to become the hydrotreated feed 128 which is combined with the solvent-feed 120 and hydrogen 126.

Continuing flow 160 flows into second separator 162 where second separator waste gases 164 are removed to create the reacted separated flow 170. Reacted separated flow 170 then flows into flasher 172 to form flasher waste gases 174 and reacted separated flashed flow 180. The flasher waste gases 174 are cooled by condenser 176 to form solvent 112 which is combined with the incoming fresh feed 110.

The reacted separated flashed flow 180 then flows into stripper 182 where stripper waste gases 184 are removed to form the output product 190.

Figure 3:
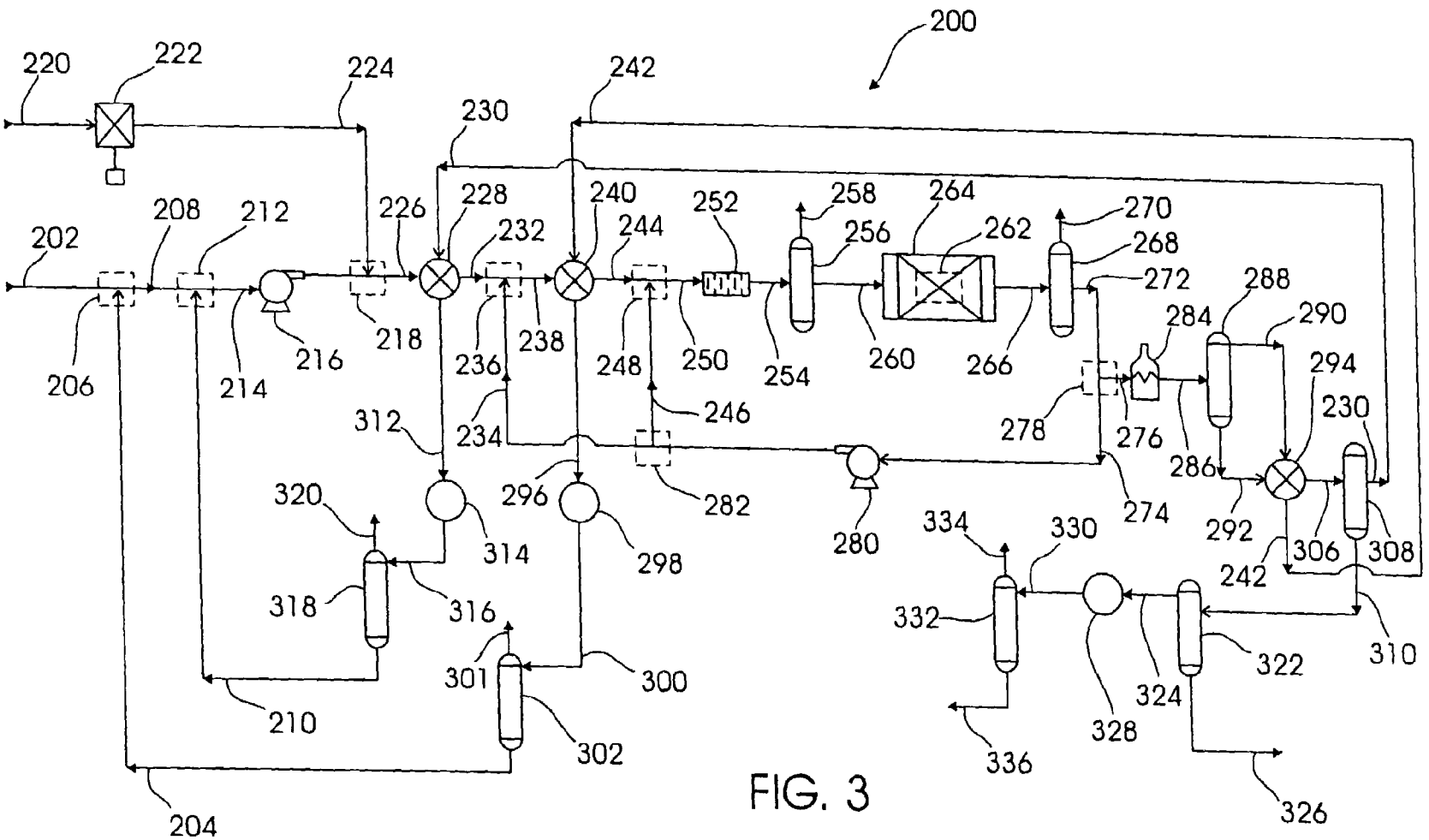
FIG. 3 is a schematic process flow diagram of a hydroprocessing system.

FIG. 3 shows a schematic process flow diagram for a hydroprocessing unit generally designated by the numeral 200.

Fresh feed stock 202 is combined with a first diluent 204 at a first combination area 206 to form first diluent-feed 208. First diluent-feed 208 is then combined with a second diluent 210 at second combination area 212 to form second diluent-feed 214. Second diluent-feed 214 is then pumped by diluent-feed charge pump 216 to third combination area 218.

Hydrogen 220 is input into hydrogen compressor 222 to make compressed hydrogen 224. The compressed hydrogen 224 flows to a third combination area 218.

Second diluent-feed 214 and compressed hydrogen 224 are combined at third combination area 218 to form hydrogen-diluent-feed mixture 226. The hydrogen-diluent-feed mixture 226 then flows through feed-product exchanger 228 which warms the mixture 226, by use of the third separator exhaust 230, to form the first exchanger flow 232. First exchanger flow 232 and first recycle flow 234 are combined at fourth combination area 236 to form first recycle feed 238.

The first recycle feed 238 then flows through first feed-product exchanger 240 which warms the mixture 238, by use of the exchanged first rectifier exchanged exhaust 242, to form the second exchanger flow 244. Second exchanger flow 244 and second recycle flow 246 are combined at fifth combination area 248 to form second recycle feed 250.

The second recycle feed 250 is then mixed in feed-recycle mixer 252 to form feed-recycle mixture 254. Feed-recycle mixture 254 then flows into reactor inlet separator 256.

Feed-recycle mixture 254 is separated in reactor inlet separator 256 to form reactor inlet separator waste gases 258 and inlet separated mixture 260. The reactor inlet separator waste gases 258 are flared or otherwise removed from the present system 200.

Inlet separated mixture 260 is combined with catalyst 262 in reactor 264 to form reacted mixture 266. Reacted mixture 266 flows into reactor outlet separator 268.

Reacted mixture 266 is separated in reactor outlet separator 268 to form reactor outlet separator waste gases 270 and outlet separated mixture 272. Reactor outlet separator waste gases 270 flow from the reactor outlet separator 268 and are then flared or otherwise removed from the present system 200.

Outlet separated mixture 272 flows out of reactor outlet separator 268 and is split into large recycle flow 274 and continuing outlet separated mixture 276 at first split area 278.

Large recycle flow 274 is pumped through recycle pumps 280 to second split area 282. Large recycle flow 274 is split at combination area 282 into first recycle flow 234 and second recycle flow 246 which are used as previously discussed.

Continuing outlet separated mixture 276 leaves first split area 278 and flows into effluent heater 284 to become heated effluent flow 286.

Heated effluent flow 286 flows into first rectifier 288 where it is split into first rectifier exhaust 290 and first rectifier flow 292. First rectifier exhaust 290 and first rectifier flow 292 separately flow into second exchanger 294 where their temperature difference is reduced.

The exchanger transforms first rectifier exhaust 290 into first rectifier exchanged exhaust 242 which flows to first feed-product exchanger 240 as previously described. First feed-product exchanger 240 cools first rectifier exchanged exhaust 242 even further to form first double cooled exhaust 296.

First double cooled exhaust 296 is then cooled by condenser 298 to become first condensed exhaust 300. First condensed exhaust 300 then flows into reflux accumulator 302 where it is split into exhaust 304 and first diluent 204. Exhaust 304 is exhausted from the system 200. First diluent 204 flows to first combination area 206 to combine with the fresh feed stock 202 as previously discussed.

The exchanger transforms first rectifier flow 292 into first rectifier exchanged flow 306 which flows into third separator 308. Third separator 308 splits first rectifier exchanged flow 306 into third separator exhaust 230 and second rectified flow 310.

Third separator exhaust 230 flows to exchanger 228 as previously described. Exchanger 228 cools third separator exhaust 230 to form second cooled exhaust 312.

Second cooled exhaust 312 is then cooled by condenser 314 to become third condensed exhaust 316. Third condensed exhaust 316 then flows into reflux accumulator 318 where it is split into reflux accumulator exhaust 320 and second diluent 210. Reflux accumulator exhaust 320 is exhausted from the system 200. Second diluent 210 flows to second combination area 212 to rejoin the system 200 as previously discussed.

Second rectified flow 310 flows into second rectifier 322 where it is split into third rectifier exhaust 324 and first end flow 326. First end flow 326 then exits the system 200 for use or further processing. Third rectifier exhaust 324 flows into condenser 328 where it is cooled to become third condensed exhaust 330.

Third condensed exhaust 330 flows from condenser 328 into fourth separator 332. Fourth separator 332 splits third condensed exhaust 330 into fourth separator exhaust 334 and second end flow 336. Fourth separator exhaust 334 is exhausted from the system 200. Second end flow 336 then exits the system 200 for use or further processing.

Figure 4:
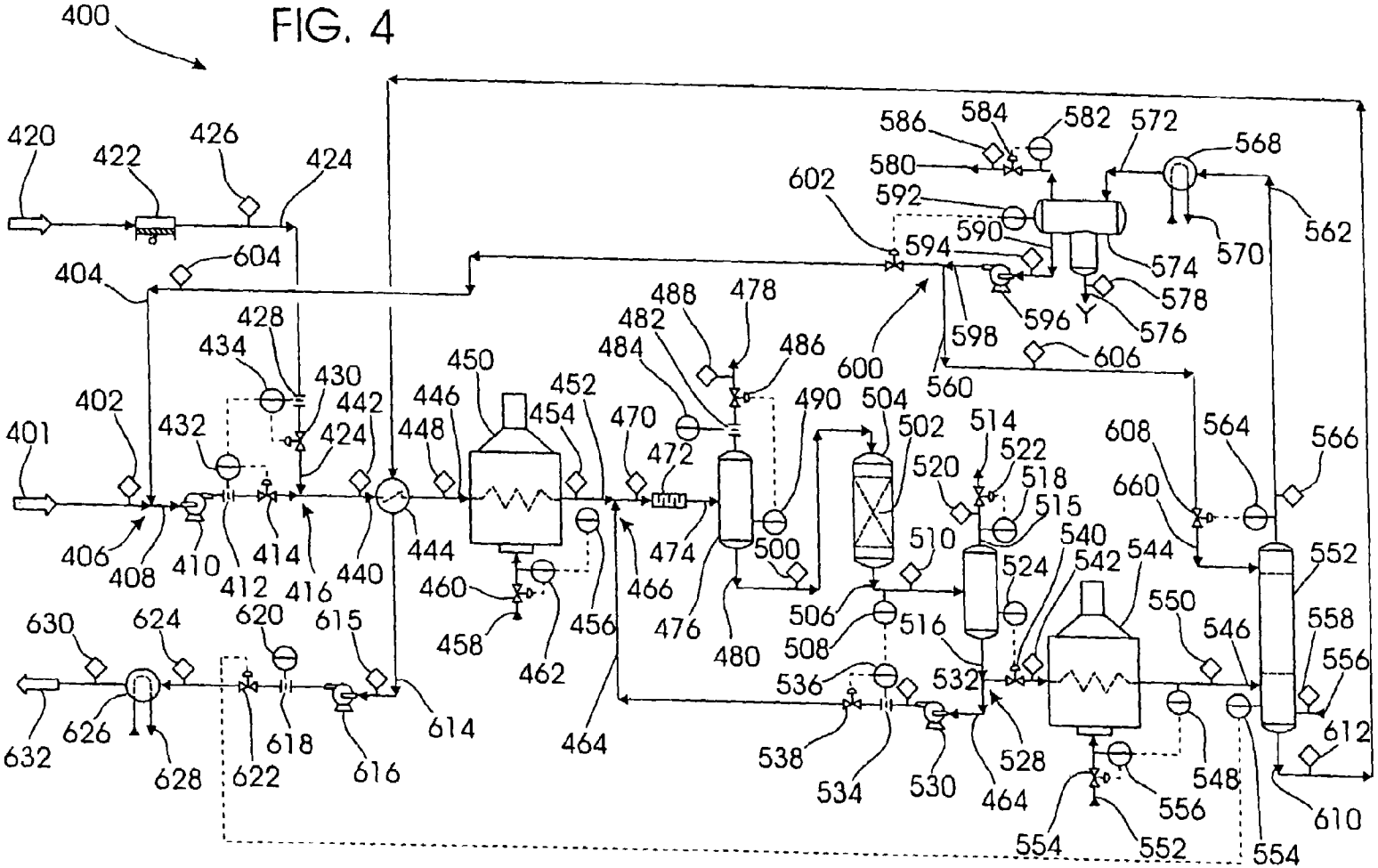
FIG. 4 is a schematic process flow diagram of a multistage reactor system.

FIG. 4 shows a schematic process flow diagram for a 1200 BPSD hydroprocessing unit generally designated by the numeral 400.

Fresh feed stock 401 is monitored at first monitoring point 402 for acceptable input parameters of approximately 260° F., at 20 psi, and 1200 BBL/D. Tile fresh feed stock 401 is then combined with a diluent 404 at first combination area 406 to form combined diluent-feed 408. Combined diluent-feed 408 is then pumped by diluent-feed charge pump 410 through first monitoring orifice 412 and first valve 414 to second combination area 416.

Hydrogen 420 is input at parameters of 100° F., 500 psi, and 40,000 SCF/HR into hydrogen compressor 422 to make compressed hydrogen 424. The hydrogen compressor 422 compresses the hydrogen 420 to 1500 psi. The compressed hydrogen 424 flows through second monitoring point 426 where it is monitored for acceptable input parameters. The compressed hydrogen 424 flows through second monitoring orifice 428 and second valve 430 to second combination area 416.

First monitoring orifice 412, first valve 414, and feed forward indicator and controller (FFIC) 434 are connected to feed indicator controller (FIC) 432 which controls the incoming flow of combined diluent-feed 408 to second combination area 416. Similarly, second monitoring orifice 428, second valve 430, and FIC 432 are connected to FFIC 434 which controls the incoming flow of compressed hydrogen 424 to second combination area 416. Combined diluent-feed 408 and compressed hydrogen 424 are combined at second combination area 416 to form hydrogen-diluent-feed mixture 440. The mixture parameters are approximately 1500 psi and 2516 BBL/D which are monitored at fourth monitoring point 442. The hydrogen-diluent-feed mixture 440 then flows through feed-product exchanger 444 whcich warms the hydrogen-diluent-feed mixture 440, by the use of the rectified product 610, to form the exchanger flow 446. The feed-product exchanger 444 works at approximately 2.584 MMBTU/HR.

The exchanger flow 446 is monitored at fifth monitoring point 448 to gather information about the parameters of the exchanger flow 446.

The exchanger flow 446 then travels into the reactor preheater 450 which is capable of heating the exchange flow 446 at 5.0 MMBTU/HR to create the preheated flow 452. Preheated flow 452 is monitored at sixth monitoring point 454 and by TIC 456.

Fuel gas 458 flows through third valve 460 and is monitored by pressure indicator and controller (PIC) 462 to supply the fuel for the reactor preheater 450. PIC 462 is connected to third valve 460 and temperature indicator and controller (TIC) 456.

Preheated flow 452 is combined with recycle flow 464 at third combination area 466 to form preheated-recycle flow 468. Preheated-recycled flow 468 is monitored at seventh monitoring point 470. The preheated-recycled flow 468 is then mixed in feed-recycle mixer 472 to form feed-recycle mixture 474. Feed-recycle mixture 474 then flows into reactor inlet separator 476. The reactor inlet separator 476 has parameters of 60" I.D.×10'0"S/S.

Feed-recycle mixture 474 is separated in reactor inlet separator 476 to form reactor inlet separator waste gases 478 and inlet separated mixture 480. Reactor inlet separator waste gases 478 flow from the reactor inlet separator 476 through third monitoring orifice 482 which is connected to F1 484. The reactor inlet separator waste gases 478 then travel through fourth valve 486, past eighth monitoring point 488 and are then flared or otherwise removed from the present system 400.

Liquid indicator and controller (LIC) 490 is connected to both fourth valve 486 and reactor inlet separator 476.

Inlet separated mixture 480 flows out of the reactor inlet separator 476 with parameters of approximately 590° F. and 1500 psi which are monitored at ninth monitoring point 500.

Inlet separated mixture 480 is combined with catalyst 502 in reactor 504 to form reacted mixture 506. Reacted mixture 506 is monitored by TIC 508 and at tenth monitoring point 510 for processing control. The reacted mixture 506 has parameters of 605° F. and 1450 psi as it flows into reactor outlet separator 512.

Reacted mixture 506 is separated in reactor outlet separator 512 to form reactor outlet separator waste gases 514 and outlet separated mixture 516. Reactor outlet separator waste gases 514 flow from the reactor outlet separator 512 through monitor 515 for PIC 518. The reactor outlet separator waste gases 514 then travel past eleventh monitoring point 520 and through fifth valve 522 and are then flared or otherwise removed from the present system 400.

The reactor outlet separator 512 is connected to controller LIC 524. The reactor outlet separator 512 has parameters of 60" I.D.×10'-0' S/S.

Outlet separated mixture 516 flows out of reactor outlet separator 512 and is split into both recycle flow 464 and continuing outlet separated mixture 526 at first split area 528.

Recycle flow 464 is pumped through recycle pumps 530 and past twelfth monitoring point 532 to fourth monitoring orifice 534. Fourth monitoring orifice 534 is connected to FIC 536 which is connected to TIC 508. FIC 536 controls sixth valve 538. After the recycle flow 464 leaves fourth monitoring orifice 534, the flow 464 flows through sixth valve 538 and on to third combination area 466 where it combines with preheated flow 452 as previously discussed.

Outlet separated mixture 526 leaves first split area 528 and flows through seventh valve 540 which is controlled by LIC 524. Outlet separated mixture 526 then flows past thirteenth monitoring point 542 to effluent heater 544.

Outlet separated mixture 526 then travels into the effluent heater 544 which is capable of heating the outlet separated mixture 526 at 3.0 MMBTU/HR to create the heated effluent flow 546. The heated effluent flow 546 is monitored by TIC 548 and at fourteenth monitoring point 550. Fuel gas 552 flows through eighth valve 554 and is monitored by PIC 556 to supply the fuel for the effluent heater 544. PIC 556 is connected to eighth valve 554 and TIC 548.

Heated effluent flow 546 flows from fourteenth monitoring point 550 into rectifier 552. Rectifier 552 is connected to LIC 554. Steam 556 flows into rectifier 552 through twentieth monitoring point 558. Return diluent flow 560 also flows into rectifier 552. Rectifier 552 has parameters of 42" I.D.×54'-0" S/S.

Rectifier diluent 562 flows out of rectifier 552 past monitors for TIC 564 and past fifteenth monitoring point 566. Rectifier diluent 562 then flows through rectifier overhead condenser 568. Rectifier overhead condenser 568 uses flow CWS/R 570 to change rectifier diluent 562 to form condensed diluent 572. Rectifier overhead condenser 568 has parameters of 5.56 MMBTU/HR.

Condensed diluent 572 then flows into rectifier reflux accumulator 574. Rectifier reflux accumulator 574 has parameters of 42" I.D.×10'-0" S/S. Rectifier reflux accumulator 547 is monitored by LIC 592. Rectifier reflux accumulator 574 splits the condensed diluent 572 into three streams: drain stream 576, gas stream 580, and diluent stream 590.

Drain stream 576 flows out of rectifier reflux accumulator 574 and past monitor 578 out of the system 400.

Gas stream 580 flows out of rectifier reflux accumulator 574, past eighteenth monitoring point 594, and through pump 596 to form pumped diluent stream 598. Pumped diluent stream 598 is then split into diluent 404 and return diluent flow 560 at second split area 600. Diluent 404 flows from second split area 600, through tenth valve 602 and third monitoring point 604. Diluent 404 then flows from third monitoring point 604 to first combination area 406 where it combines with fresh feed stock 401 as previously discussed.

Return diluent flow 560 flows from second split area 600, past nineteenth monitoring point 606, through eleventh valve 608 and into rectifier 552. Eleventh valve 608 is connected to TIC 564.

Rectified product 610 flows out of rectifier 552, past twenty-first monitoring point 612 and into exchanger 444 to form exchanged rectified product 614. Exchanged rectified product 614 then flows past twenty-second monitoring point 615 and through product pump 616. Exchanged rectified product 614 flows from pump 616 through fifth monitoring orifice 618. Sixth monitoring orifice 618 is connected to F1 620. Exchanged rectified product then flows from sixth monitoring orifice 618 to twelfth valve 622. Twelfth valve 622 is connected to LIC 554. Exchanged rectified product 614 then flows from twelfth valve 622 through twenty-third monitoring point 624 and into product cooler 626 where it is cooled to form final product 632. Product cooler 626 uses CWS/R 628. Product cooler has parameters of 0.640 MMBTU/HR. Final product 632 flows out of cooler 626, past twenty-fourth monitoring point 630 and out of the system 400.

Figure 5:
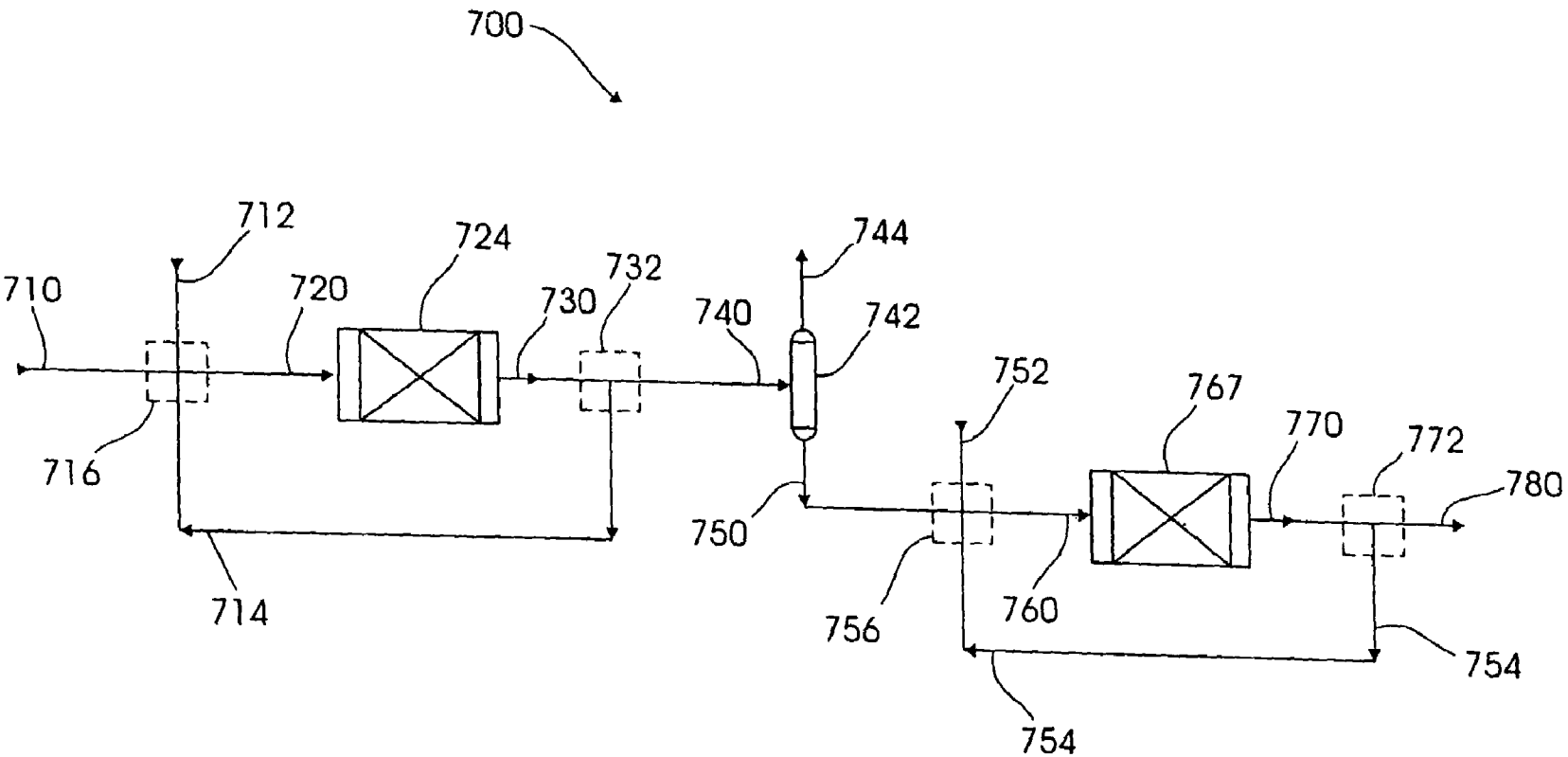
FIG. 5 is a schematic process flow diagram of a 1200 BPSD hydroprocessing unit.

FIG. 5 shows a schematic process flow diagram for a multistage hydrotreater generally designated by the numeral 700. Feed 710 is combined with hydrogen 712 and first recycle stream 714 in area 716 to form combined feed-hydrogen-recycle stream 720. The combined feed-hydrogen-recycle stream 720 flows into first reactor 724 where it is reacted to form first reactor output flow 730. The first reactor output flow 730 is divided to form first recycle stream 714 and first continuing reactor flow 740 at area 732. First continuing reactor flow 740 flows into stripper 742 where stripper waste gases 744 such as $H_2S$, $NH_3$, and $H_2O$ are removed to form stripped flow 750.

Stripped flow 750 is then combined with additional hydrogen 752 and second recycle stream 754 in area 756 to form combined stripped-hydrogen-recycle stream 760. The combined stripped-hydrogen-recycle stream 760 flows into saturation reactor 764 where it is reacted to form second reactor output flow 770. The second reactor output flow 770 is divided at area 772 to form second recycle stream 754 and product output 780.

Figure 6:
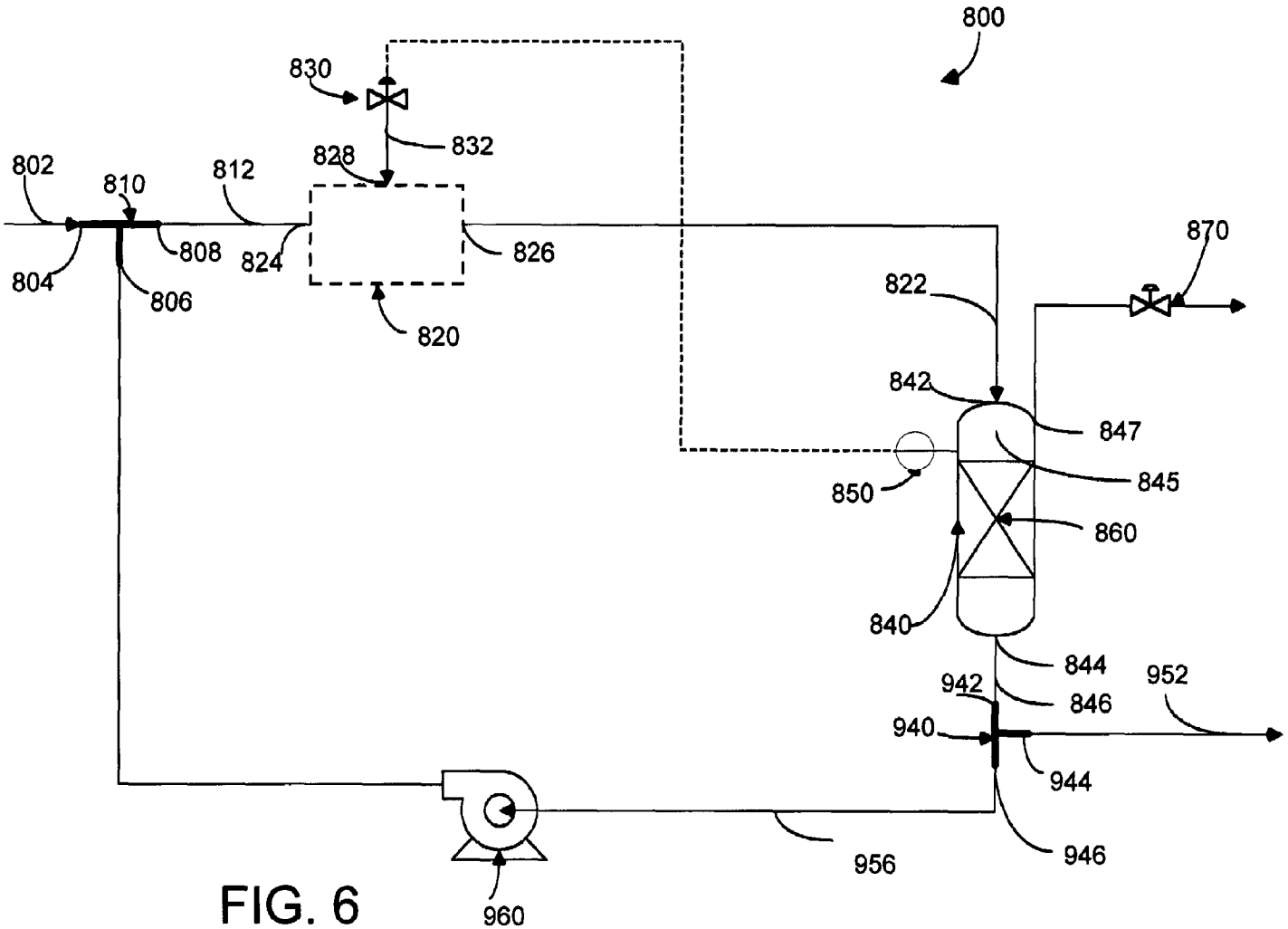
FIG. 6 is a schematic of a down flow reactor system where the quantity of liquid in the reactor is controlled by the level of the liquid in the reactor.

FIG. 6 shows a schematic for a down flow reactor system, generally designated by the numeral 800 where the quantity of liquid in the reactor is controlled by the level of the liquid in the reactor. Fresh feed stock 802 flows into first split area 810 through first orifice 804. Recycled reacted product 956 flows into second orifice 806 and the combined recycled reacted product and feed, 812, exits first split area 810 through third orifice 808. Combined recycled reacted product and feed 812 then enters mixer 820 through first mixer inlet 824 where it is combined with hydrogen 832, which enters mixer 820 through second mixer inlet 828. The quantity of hydrogen 832 is controlled by hydrogen valve 830. Recycled reacted product/feed/hydrogen 822 exits mixer 820 through mixer outlet 826 and flows into reactor 840 through reactor inlet 842. Inside reactor 840, recycled reacted product/feed/hydrogen 822 flows through catalyst bed 860 where it reacts. As recycled reacted product/feed/hydrogen 822 reacts, hydrogen gas and light end hydrocarbon gases, 845, may come out of solution and accumulate at the top of reactor 840. Gases 845 are removed from reactor 840 through reactor orifice 847. The rate at which gases 845 are removed from reactor 840 through orifice 847 is controlled by vent valve 870.

The level of the liquid recycled reacted product/feed/hydrogen 822 is monitored at level controller 850 which is above catalyst bed 860. If the level of liquid recycled reacted product/feed/hydrogen 822 rises above the desired liquid level, level controller 850 will signal to hydrogen valve 830 to increase the amount of hydrogen to mixer 820. If the level of liquid recycled reacted product/feed/hydrogen 822 drops below the desired liquid level, level controller 850 will signal to hydrogen valve 830 to decrease the amount of hydrogen into mixer 820.

Reacted liquid 846 exits reactor 840 through reactor outlet 844. Reacted liquid 846 flows into second split area 940 through fourth orifice 942 where it is split into two flows, split reacted product 952, which exits second split area 940 through fifth orifice 944, and recycled reacted product 956 which exits second split area 940 through sixth orifice 946. Recycled reacted product 956 is pumped through recycle pump 960 before mixing with fresh feed 802 at first split area 810.

Figure 7:
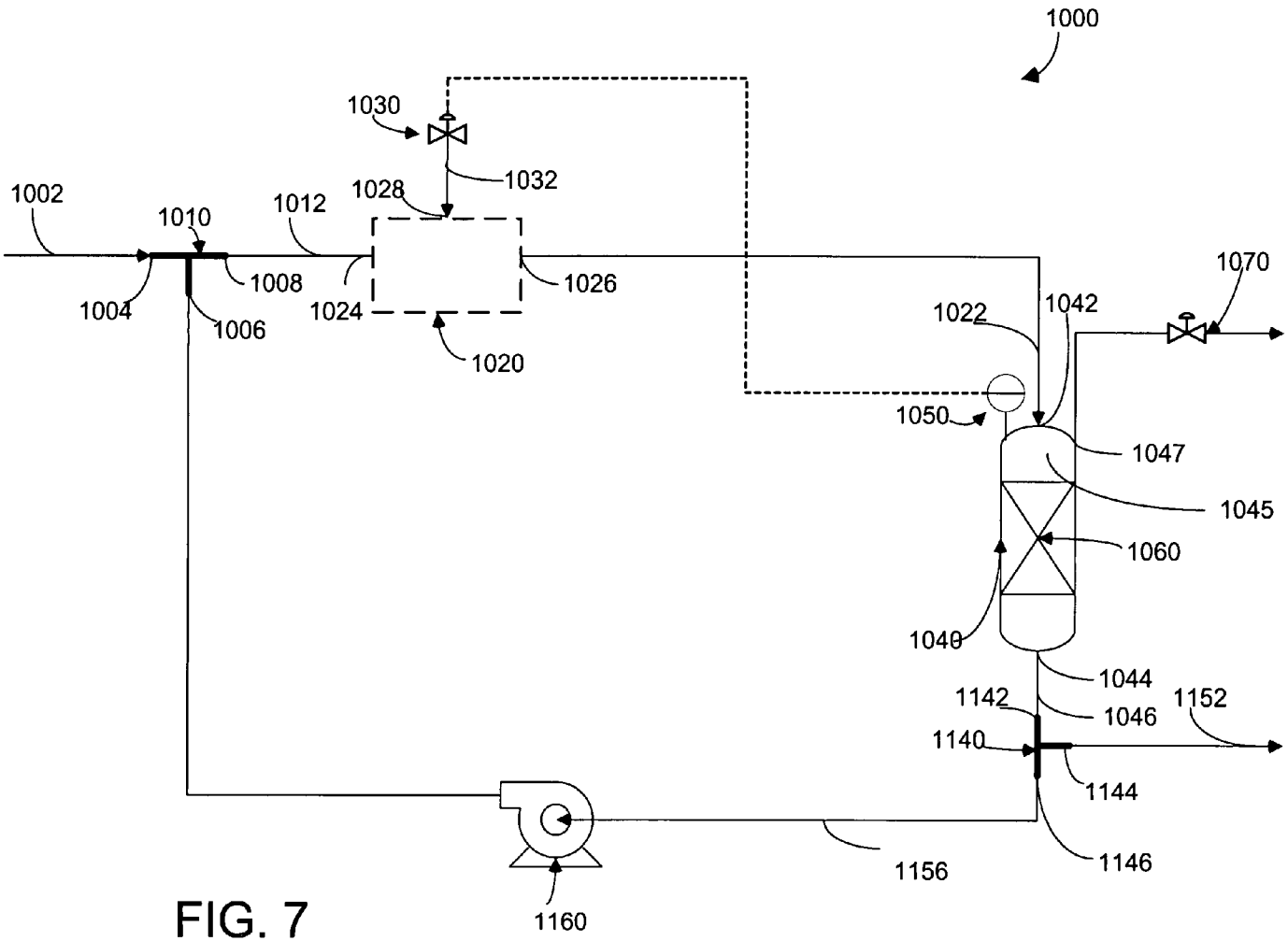
FIG. 7 is a schematic of a down flow reactor system where the quantity of liquid in the reactor is controlled by the pressure of the gases in the reactor.

FIG. 7 shows a schematic for a down flow reactor system, generally designated by the numeral 1000 where the quantity of liquid in the reactor is controlled by the pressure of the gases in the reactor. Fresh feed stock 1002 flows into first split area 1010 through first orifice 1004. Recycled reacted product 1156 flows into second orifice 1006 and the combined recycled reacted product and feed, 1012, exits first split area 1010 through third orifice 1008. Combined recycled reacted product and feed 1012 then enters mixer 1020 through first mixer inlet 1024 where it is combined with hydrogen 1032, which enters mixer 1020 through second mixer inlet 1028. The quantity of hydrogen 1032 is controlled by hydrogen valve 1030. Recycled reacted product/feed/hydrogen 1022 exits mixer 1020 through mixer outlet 1026 and flows into reactor 1040 through reactor inlet 1042. Inside reactor 1040, recycled reacted product/feed/hydrogen 1022 flows through catalyst bed 1060 where it reacts. As recycled reacted product/feed/hydrogen 1022 reacts, hydrogen gas and light end hydrocarbon gases, 1045, may come out of solution and accumulate at the top of reactor 1040. Gases 1045 are removed from reactor 1040 through reactor orifice 1047. The rate at which gases 1045 are removed from reactor 1040 through orifice 1047 is controlled by vent valve 1070.

The pressure of excess hydrogen and light end hydrocarbon gases, 1045, are monitored at pressure controller 1050 which is above catalyst bed 1060. If the pressure of gases 1045 rises above the desired gas pressure, pressure controller 1050 will signal to hydrogen valve 1030 to decrease the amount of hydrogen to mixer 1020. If the pressure of gases 1045 drops below the desired gas pressure, pressure controller 1050 will signal to hydrogen valve 1030 to increase the amount of hydrogen into mixer 1020.

Reacted product 1046 exits reactor 1040 through reactor outlet 1044. Reacted product 1046 flows into second split area 1140 through fourth orifice 1142 where it is split into two flows, split reacted product 1152, which exits second split area 1140 through fifth orifice 1144, and recycled reacted product 1156 which exits second split area 1140 through sixth orifice 1146. Recycled reacted product 1156 is pumped through recycle pump 1160 before mixing with fresh feed 1002 at first split area 1010.

Figure 8:
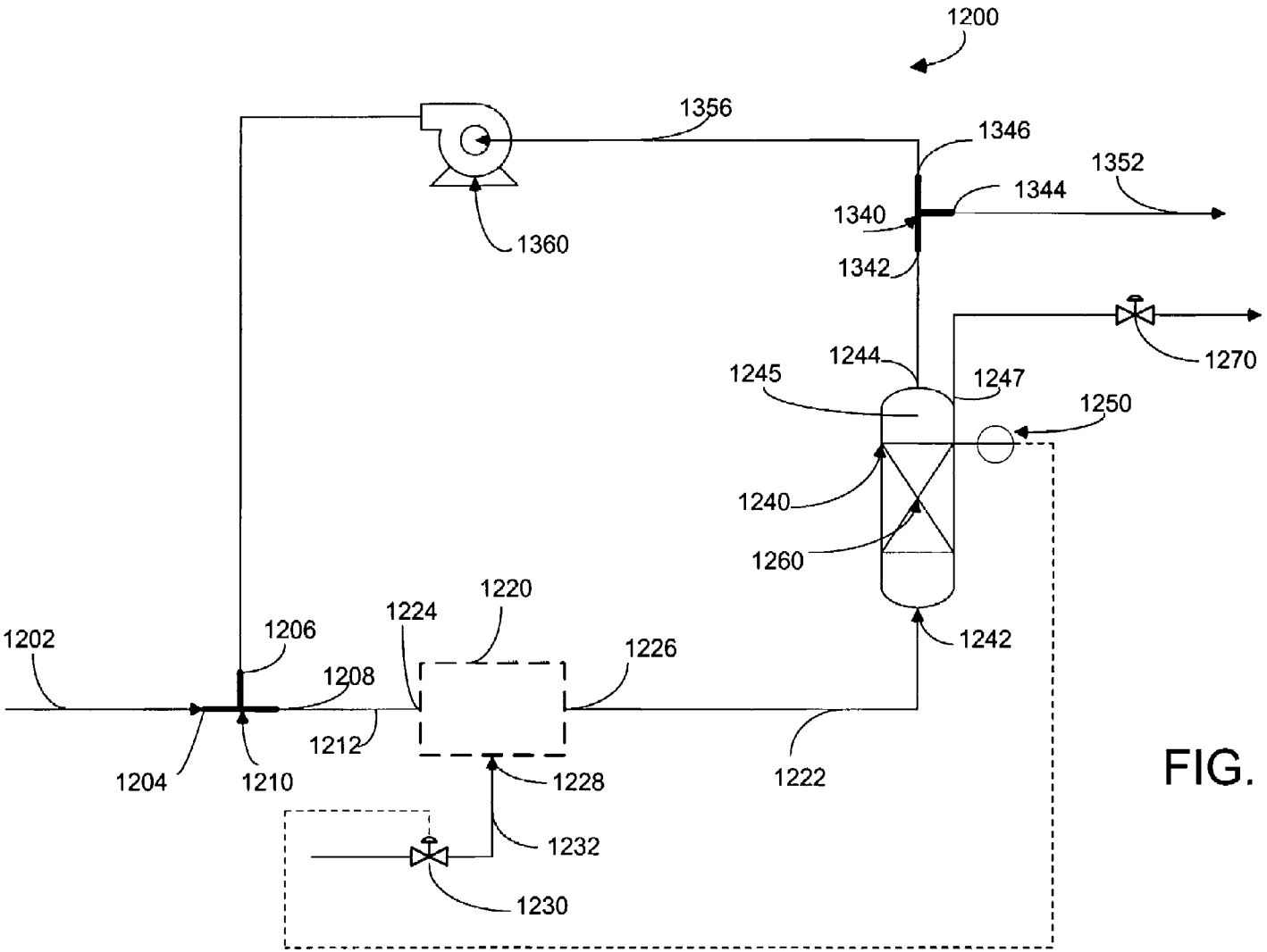
FIG. 8 is a schematic of an up flow reactor system where the quantity of liquid in the reactor is controlled by the level of the liquid in the reactor.

FIG. 8 shows a schematic for an up flow reactor system, generally designated by the numeral 1200 where the quantity of liquid in the reactor is controlled by the level of the liquid in the reactor. Fresh feed stock 1202 flows into first split area 1210 through first orifice 1204. Recycled reacted product 1356 flows into second orifice 1206 and the combined recycled reacted product and feed 1212, exits first split area 1210 through third orifice 1208. Combined recycled reacted product and feed 1212 then enters mixer 1220 through first mixer inlet 1224 where it is combined with hydrogen 1232, which enters mixer 1220 through second mixer inlet 1228. The quantity of hydrogen 1232 is controlled by hydrogen valve 1230. Recycled reacted product/feed/hydrogen 1222 exits mixer 1220 through mixer outlet 1226 and flows into reactor 1240 through reactor inlet 1242. Inside reactor 1240, recycled reacted product/feed/hydrogen 1222 flows through catalyst bed 1260 where it reacts. As recycled reacted product/feed/hydrogen 1222 reacts, hydrogen gas and light end hydrocarbon gases, 1245, may come out of solution and accumulate at the top of reactor 1240. Gases 1245 are removed from reactor 1240 through reactor orifice 1247. The rate at which gases 1245 are removed from reactor 1240 through orifice 1247 is controlled by vent valve 1270.

The level of the liquid recycled reacted product/feed/hydrogen 1222 is monitored at level controller 1250 which is above catalyst bed 1260. If the level of liquid recycled reacted product/feed/hydrogen 1222 rises above the desired liquid level, level controller 1250 will signal to hydrogen valve 1230 to increase the amount of hydrogen to mixer 1220. If the level of liquid recycled reacted product/feed/hydrogen 1222 drops below the desired liquid level, level controller 1250 will signal to hydrogen valve 1230 to decrease the amount of hydrogen into mixer 1220.

Reacted product 1246 exits reactor 1240 through reactor outlet 1244. Reacted product 1246 flows into second split area 1240 through fourth orifice 1242 where it is split into two flows, split reacted product 1252, which exits second split area 1340 through fifth orifice 1344, and recycled reacted product 1356 which exits second split area 1340 through sixth orifice 1346. Recycled reacted product 1356 is pumped through recycle pump 1360 before mixing with fresh feed 1202 at first split area 1210.

Figure 9:
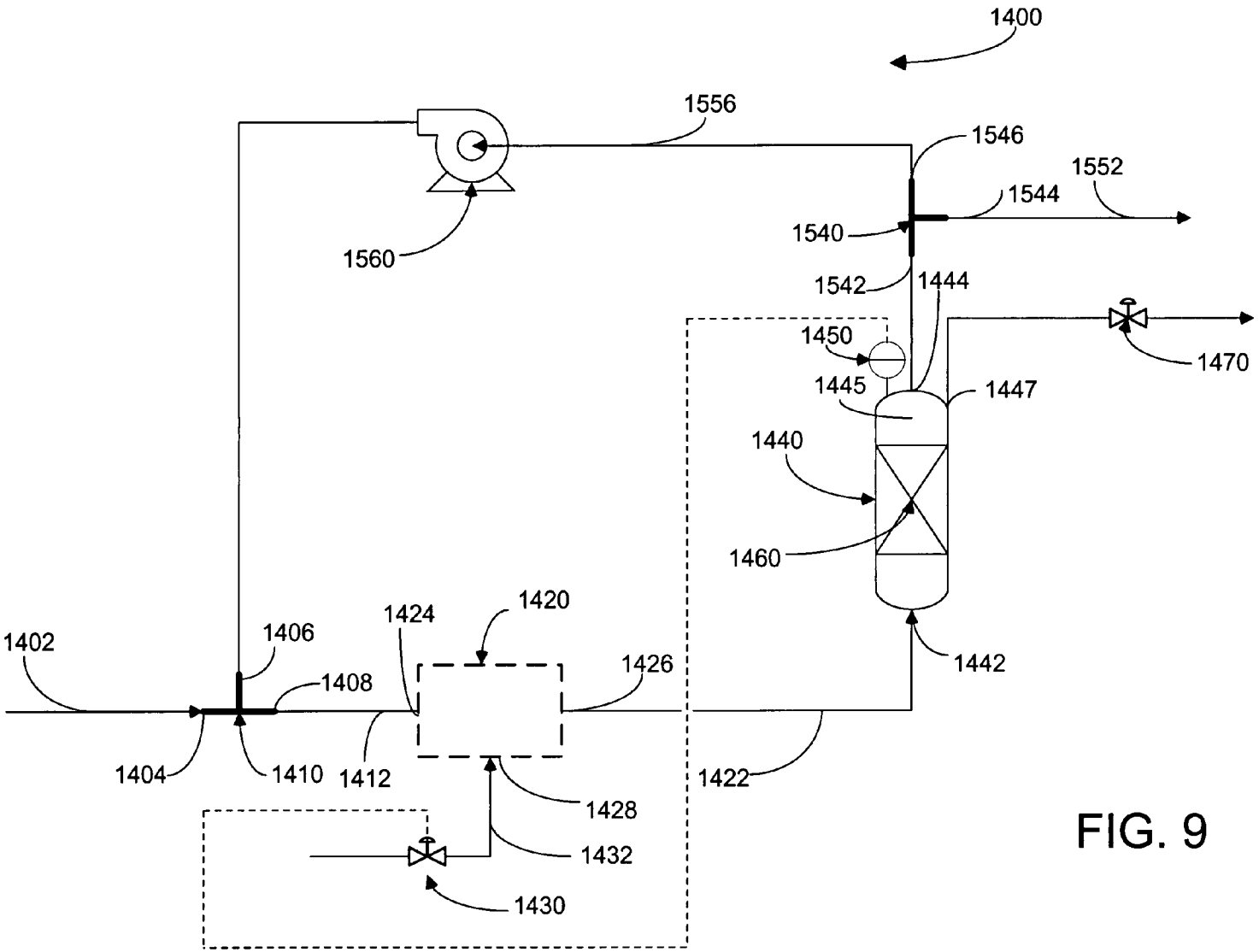
FIG. 9 is a schematic of an up flow reactor system where the quantity of liquid in the reactor is controlled by the pressure of the gases in the reactor.

FIG. 9 shows a schematic for an up flow reactor system, generally designated by the numeral 1400 where the quantity of liquid in the reactor is controlled by the pressure of the gases in the reactor. Fresh feed stock 1402 flows into first split area 1410 through first orifice 1404. Recycled reacted product 1556 flows into second orifice 1406 and the combined recycled reacted product and feed, 1412, exits first split area 1410 through third orifice 1408. Combined recycled reacted product and feed 1412 then enters mixer 1420 through first mixer inlet 1424 where it is combined with hydrogen 1432, which enters mixer 1420 through second mixer inlet 1428. The quantity of hydrogen 1432 is controlled by hydrogen valve 1430. Recycled reacted product/feed/hydrogen 1422 exits mixer 1420 through mixer outlet 1426 and flows into reactor 1440 through reactor inlet 1442. Inside reactor 1440, recycled reacted product/feed/hydrogen 1422 flows through catalyst bed 1460 where it reacts. As recycled reacted product/feed/hydrogen 1422 reacts, hydrogen gas and light end hydrocarbon gases, 1445, may come out of solution and accumulate at the top of reactor 1440. Gases 1445 are removed from reactor 1440 through reactor orifice 1447. The rate at which gases 1445 are removed from reactor 1440 through orifice 1447 is controlled by vent valve 1470.

The pressure of excess hydrogen and light end hydrocarbon gases, 1445, are monitored at pressure controller 1450 which is above catalyst bed 1460. If the pressure of gases 1445 rises above the desired gas pressure, pressure controller 1450 will signal to hydrogen valve 1430 to decrease the amount of hydrogen to mixer 1420. If the pressure of gases 1445 drops below the desired gas pressure, pressure controller 1450 will signal to hydrogen valve 1430 to increase the amount of hydrogen into mixer 1420.

Reacted product 1446 exits reactor 1440 through reactor outlet 1444. Reacted product 1446 flows into second split area 1540 through fourth orifice 1542 where it is split into two flows, split reacted product 1552, which exits second split area 1540 through fifth orifice 1544, and recycled reacted product 1556 which exits second split area 1540 through sixth orifice 1546. Recycled reacted product 1556 is pumped through recycle pump 1560 before mixing with fresh feed 1402 at first split area 1410.

Figure 10:
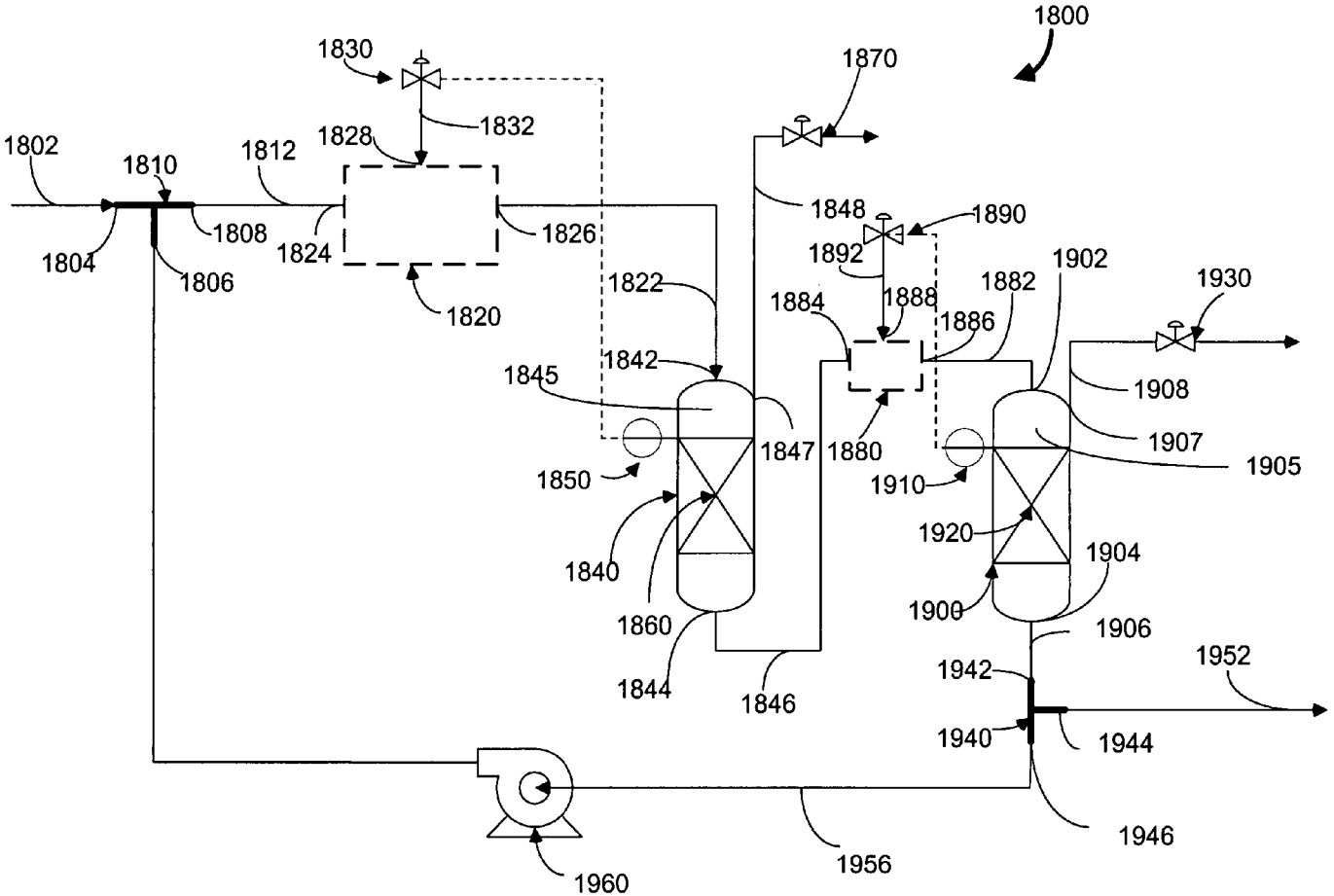
FIG. 10 is a schematic of a down flow two reactor system where the quantity of liquid in the reactor is controlled by the level of the liquid in the reactor.

FIG. 10 shows a schematic for a down flow two-reactor system, generally designated by the numeral 1800 where the quantity of liquid in the reactor is controlled by the level of the liquid in the reactor. Fresh feed stock 1802 flows into first split area 1810 through first orifice 1804. Recycled reacted product 1956 flows into second orifice 1806 and the combined recycled reacted product and feed 1812, exits first split area 1810 through third orifice 1808. Combined recycled reacted product and feed 1812 then enters first mixer 1820 through first mixer inlet 1824 where it is combined with hydrogen 1832, which enters first mixer 1820 through second mixer inlet 1828. The quantity of hydrogen 1832 is controlled by first hydrogen valve 1830. Recycled reacted product/feed/hydrogen 1822 exits first mixer 1820 through first mixer outlet 1826 and flows into first reactor 1840 through first reactor inlet 1842. Inside first reactor 1840, recycled reacted product/feed/hydrogen 1822 flows through first catalyst bed 1860 where it reacts. As recycled reacted product/feed/hydrogen 1822 reacts, first catalyst bed hydrogen gas and light end hydrocarbon gases, 1845, may come out of solution and accumulate at the top of first reactor 1840. First catalyst bed gases 1845 are removed from first reactor 1840 through first reactor orifice 1847. The rate at which first catalyst bed gases 1845 are removed from first reactor 1840 through first reactor orifice 1847 is controlled by first vent valve 1870.

The level of the liquid recycled reacted product/feed/hydrogen 1822 is monitored at first level controller 1850 which is above first catalyst bed 1860. If the level of liquid recycled reacted product/feed/hydrogen 1822 rises above the desired liquid level, first level controller 1850 will signal to first hydrogen valve 1830 to increase the amount of hydrogen to first mixer 1820. If the level of liquid recycled reacted product/feed/hydrogen 1822 drops below the desired liquid level, first level controller 1850 will signal to first hydrogen valve 1830 to decrease the amount of hydrogen into first mixer 1820.

First catalyst bed product 1846 exits first reactor 1840 through first reactor outlet 1844. First catalyst bed product 1846 flows into second mixer 1880 through third mixer inlet 1884, where it is combined with hydrogen 1892 which enters second mixer 1880 through fourth mixer inlet 1888. The quantity of hydrogen 1892 is controlled by second hydrogen valve 1890. First catalyst bed product/hydrogen 1882 exits second mixer 1880 through second mixer outlet 1886 and flows into second reactor 1900 through second reactor inlet 1902. Inside second reactor 1900, first catalyst bed product/hydrogen 1882 flows through second catalyst bed 1920 where it reacts. As first catalyst bed product/hydrogen 1882 reacts, second catalyst bed hydrogen gas and light end hydrocarbon gases 1905 may come out of solution and accumulate at the top of second reactor 1900. Second catalyst bed gases 1905 are removed from second reactor 1900 through second reactor orifice 1907. The rate at which second catalyst bed gases 1905 are removed from second reactor 1900 through second reactor orifice 1907 is controlled by second vent valve 1930.

The level of the first catalyst bed product/hydrogen 1882 is monitored at second level controller 1910 which is above second catalyst bed 1920. If the level of first catalyst bed product/hydrogen 1882 rises above the desired liquid level, second level controller 1910 will signal to second hydrogen valve 1890 to increase the amount of hydrogen to second mixer 1880. If the level of first catalyst bed product/hydrogen 1882 drops below the desired liquid level, second level controller 1910 will signal to second hydrogen valve 1890 to decrease the amount of hydrogen into second mixer 1880.

Reacted product 1906 exits second reactor 1900 through second reactor outlet 1904. Reacted product 1906 flows into second split area 1940 through fourth orifice 1942 where it is split into two flows, split reacted product 1952, which exits second split area 1940 through fifth orifice 1944, and recycled reacted product 1956 which exits second split area 1940 through sixth orifice 1946. Recycled reacted product 1956 is pumped through recycle pump 1960 before mixing with fresh feed 1802 at first split area 1810.

Figure 11:
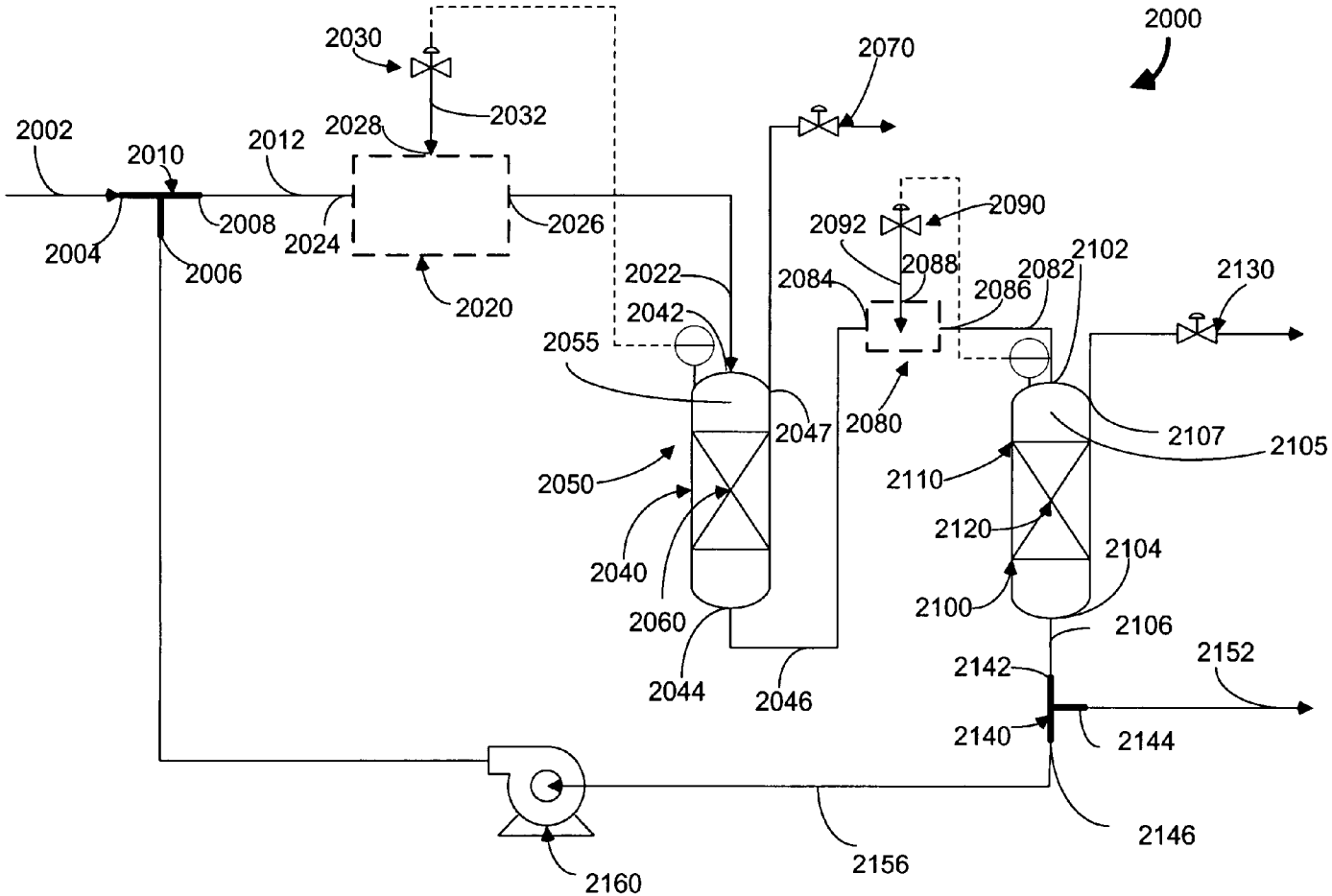
FIG. 11 is a schematic of a down flow two reactor system where the quantity of liquid in the reactor is controlled by the pressure of the gases in the reactor.

FIG. 11 shows a schematic for a down flow two-reactor system, generally designated by the numeral 2000 where the quantity of liquid in the reactor is controlled by the pressure of the gases in the reactor. Fresh feed stock 2002 flows into first split area 2010 through first orifice 2004. Recycled reacted product 2156 flows into second orifice 2006 and the combined recycled reacted product and feed 2012 exits first split area 2010 through third orifice 2008. Combined recycled reacted product and feed 2012 then enters first mixer 2020 through first mixer inlet 2024 where it is combined with hydrogen 2032, which enters first mixer 2020 through second mixer inlet 2028. The quantity of hydrogen 2032 is controlled by first hydrogen valve 2030. Recycled reacted product/feed/hydrogen 2022 exits first mixer 2020 through first mixer outlet 2026 and flows into first reactor 2040 through first reactor inlet 2042. Inside first reactor 2040, recycled reacted product/feed/hydrogen 2022 flows through first catalyst bed 2060 where it reacts. As recycled reacted product/feed/hydrogen 2022 reacts, first catalyst bed hydrogen gas and light end hydrocarbon gases, 2045, may come out of solution and accumulate at the top of first reactor 2040. First catalyst bed gases 2045 are removed from first reactor 2040 through first reactor orifice 2047. The rate at which gases 2045 are removed from first reactor 2040 through first reactor orifice 2047 is controlled by first vent valve 2070.

The pressure of excess first catalyst bed hydrogen and light end hydrocarbon gases 2045 are monitored at first pressure controller 2050 which is above first catalyst bed 2060. If the pressure of first catalyst bed gases 2045 rises above the desired gas pressure, first pressure controller 2050 will signal to first hydrogen valve 2030 to decrease the amount of hydrogen to first mixer 2020. If the pressure of first catalyst bed gases 2045 drops below the desired gas pressure, first pressure controller 2050 will signal to first hydrogen valve 2030 to increase the amount of hydrogen into first mixer 2020.

First catalyst bed product 2046 exits first reactor 2040 through first reactor outlet 2044. First catalyst bed product 2046 flows into second mixer 2080 through third mixer inlet 2084 where it is combined with hydrogen 2092, which enters second mixer 2080 through fourth mixer inlet 2088. The quantity of hydrogen 2092 is controlled by second hydrogen valve 2090. First catalyst bed product/hydrogen 2082 exits second mixer 2080 through second mixer outlet 2086 and flows into second reactor 2100 through second reactor inlet 2102. Inside second reactor 2100, first catalyst bed product/hydrogen 2182 flows through second catalyst bed 2120 where it reacts. As first catalyst bed product/hydrogen 2082 reacts, second catalyst bed hydrogen gas and light end hydrocarbon gases 2105 may come out of solution and accumulate at the top of second reactor 2100. Second catalyst bed gases 2105 are removed from second reactor 2100 through second reactor orifice 2107. The rate at which second catalyst bed gases 2105 are removed from second reactor 2100 through second reactor orifice 2107 is controlled by second vent valve 2130.

The pressure of excess second catalyst bed hydrogen and light end hydrocarbon gases 2105 are monitored at second pressure controller 2110 which is above second catalyst bed 2120. If the pressure of second catalyst bed gases 2105 rises above the desired gas pressure, second pressure controller 2110 will signal to second hydrogen valve 2090 to decrease the amount of hydrogen to second mixer 2080. If the pressure of second catalyst bed gases 2105 drops below the desired gas pressure, second pressure controller 2110 will signal to second hydrogen valve 2090 to increase the amount of hydrogen into second mixer 2080.

Reacted product 2106 exits second reactor 2100 through second reactor outlet 2104. Reacted product 2106 flows into second split area 2140 through fourth orifice 2142 where it is split into two flows, split reacted product 2152, which exits second split area 2140 through fifth orifice 2144, and recycled reacted product 2156 which exits second split area 2140 through sixth orifice 2146. Recycled reacted product 2156 is pumped through recycle pump 2160 before mixing with fresh feed 2002 at first split area 2010.

Figure 12:
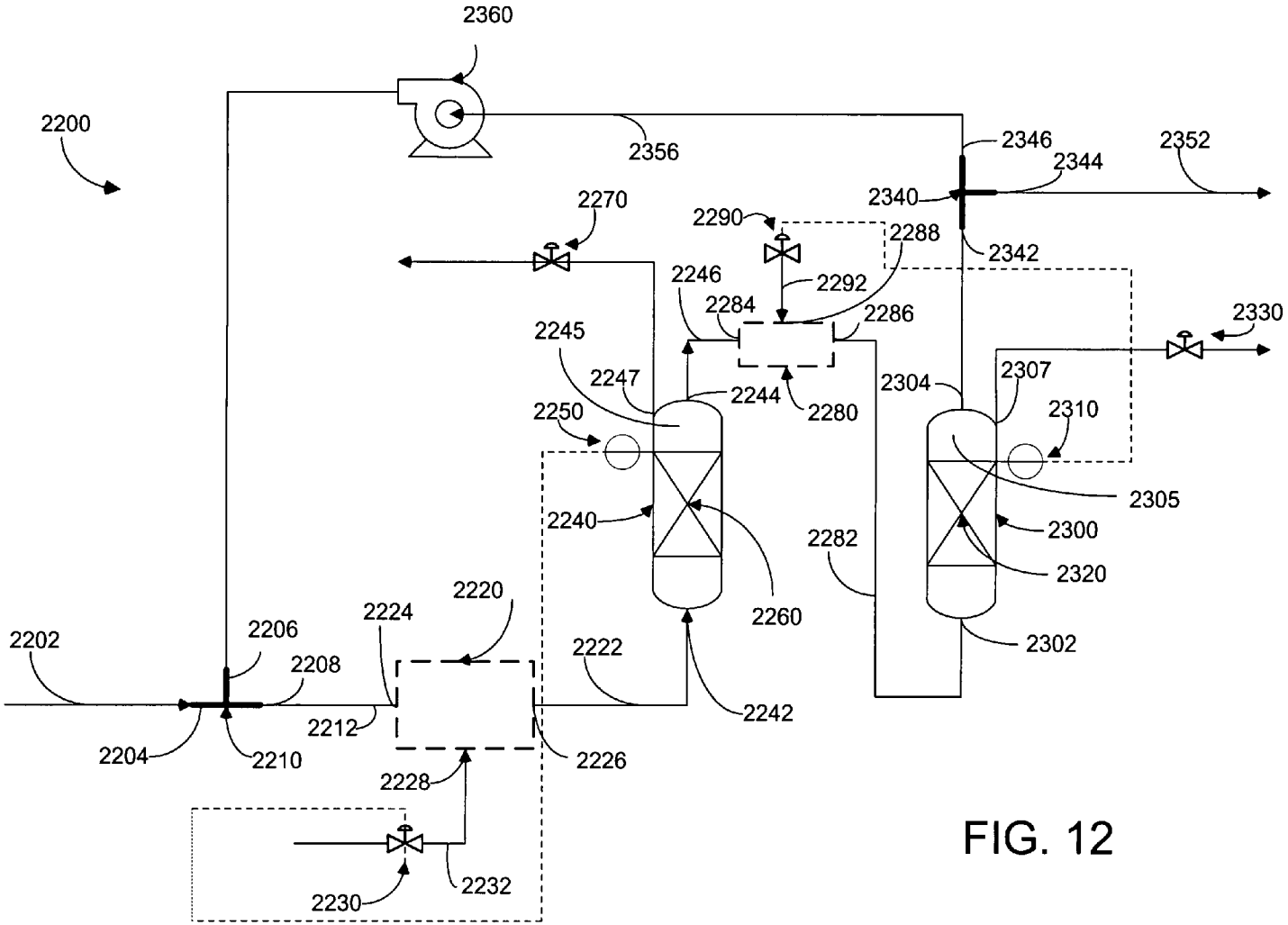
FIG. 12 is a schematic of an up flow two reactor system where the quantity of liquid in the reactor is controlled by the level of the liquid in the reactor.

FIG. 12 shows a schematic for an up flow two-reactor system, generally designated by the numeral 2200 where the quantity of liquid in the reactor is controlled by the level of the liquid in the reactor. Fresh feed stock 2202 flows into first split area 2210 through first orifice 2204. Recycled reacted product 2356 flows into second orifice 2206 and the combined recycled reacted product and feed 2212 exits first split area 2210 through third orifice 2208. Combined recycled reacted product and feed 2212 then enters first mixer 2220 through first mixer inlet 2224 where it is combined with hydrogen 2232, which enters first mixer 2220 through second mixer inlet 2228. The quantity of hydrogen 2232 is controlled by first hydrogen valve 2230. Recycled reacted product/feed/hydrogen 2222 exits first mixer 2220 through first mixer outlet 2226 and flows into first reactor 2240 through first reactor inlet 2242. Inside first reactor 2240, recycled reacted product/feed/hydrogen 2222 flows through first catalyst bed 2260 where it reacts. As recycled reacted product/feed/hydrogen 2222 reacts, first catalyst bed hydrogen gas and light end hydrocarbon gases 2245 may come out of solution and accumulate at the top of reactor 2240. First catalyst bed gases 2245 are removed from first reactor 2240 through first reactor orifice 2247. The rate at which first catalyst bed gases 2245 are removed from first reactor 2240 through first reactor orifice 2247 is controlled by first vent valve 2270.

The level of the liquid recycled reacted product/feed/hydrogen 2222 is monitored at first level controller 2250 which is above first catalyst bed 2260. If the level of liquid recycled reacted product/feed/hydrogen 2222 rises above the desired liquid level, first level controller 2250 will signal to first hydrogen valve 2230 to increase the amount of hydrogen to first mixer 2220. If the level of liquid recycled reacted product/feed/hydrogen 2222 drops below the desired liquid level, first level controller 2250 will signal to first hydrogen valve 2230 to decrease the amount of hydrogen into first mixer 2220.

First catalyst bed product 2246 exits first reactor 2240 through first reactor outlet 2244. First catalyst bed product 2246 flows into second mixer 2280 through third mixer inlet 2284 where it is combined with hydrogen 2292, which enters second mixer 2280 through fourth mixer inlet 2288. The quantity of hydrogen 2292 is controlled by second hydrogen valve 2290. First catalyst bed product/hydrogen 2282 exits second mixer 2280 through second mixer outlet 2286 and flows into second reactor 2300 through second reactor inlet 2302. Inside second reactor 2300, first catalyst bed product/hydrogen 2282 flows through second catalyst bed 2320 where it reacts. As first catalyst bed product/hydrogen 2282 reacts, second catalyst bed hydrogen gas and light end hydrocarbon gases 2305 may come out of solution and accumulate at the top of second reactor 2300. Second catalyst bed gases 2305 are removed from second reactor 2300 through second reactor orifice 2307. The rate at which second catalyst bed gases 2305 are removed from second reactor 2300 through second reactor orifice 2307 is controlled by second vent valve 2330.

The level of the first catalyst bed product/hydrogen 2282 is monitored at second level controller 2310 which is above second catalyst bed 2320. If the level of first catalyst bed/hydrogen 2282 rises above the desired liquid level, second level controller 2310 will signal to second hydrogen valve 2290 to increase the amount of hydrogen to second mixer 2280. If the level of first catalyst bed product/hydrogen 2282 drops below the desired liquid level, second level controller 2310 will signal to second hydrogen valve 2290 to increase the amount of hydrogen into second mixer 2280.

Reacted product 2306 exits second reactor 2300 through second reactor outlet 2304. Reacted product 2306 flows into second split area 2340 through fourth orifice 2342 where it is split into two flows, split reacted product 2352, which exits second split area 2340 through fifth orifice 2344, and recycled reacted product 2356 which exits second split area 2340 through sixth orifice 2346. Recycled reacted product 2356 is pumped through recycle pump 2360 before mixing with fresh feed 2302 at first split area 2310.

Figure 13:
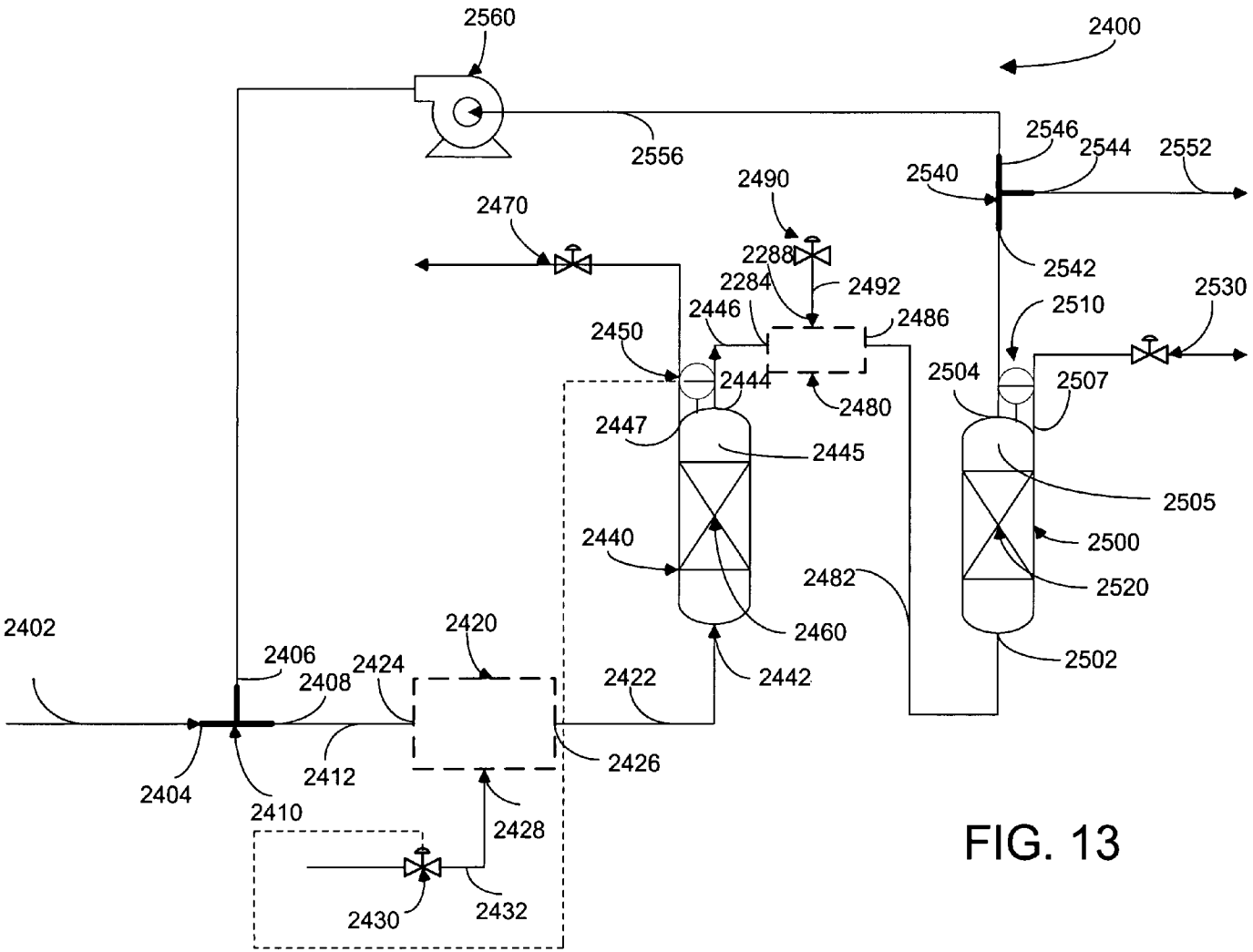
FIG. 13 is a schematic of an up flow two reactor system where the quantity of liquid in the reactor is controlled by the pressure of the gases in the reactor.

FIG. 13 shows a schematic for an up flow two-reactor system, generally designated by the numeral 2400 where the quantity of liquid in the reactor is controlled by the pressure of the gases in the reactor. Fresh feed stock 2402 flows into first split area 2410 through first orifice 2404. Recycled reacted product 2556 flows into second orifice 2406 and the combined recycled reacted product and feed, 2412, exits first split area 2410 through third orifice 2408. Combined recycled reacted product and feed 2412 then enters first mixer 2420 through first mixer inlet 2424 where it is combined with hydrogen 2432, which enters first mixer 2420 through second mixer inlet 2428. The quantity of hydrogen 2432 is controlled by first hydrogen valve 2430. Recycled reacted product/feed/hydrogen 2422 exits first mixer 2420 through first mixer outlet 2426 and flows into first reactor 2440 through first reactor inlet 2442. Inside first reactor 2440, recycled reacted product/feed/hydrogen 2422 flows through first catalyst bed 2460 where it reacts. As recycled reacted product/feed/hydrogen 2422 reacts, first catalyst bed hydrogen gas and light end hydrocarbon gases 2445 may come out of solution and accumulate at the top of first reactor 2440. First catalyst bed gases 2445 are removed from first reactor 2440 through first reactor orifice 2447. The rate at which first catalyst bed gases 2445 are removed from first reactor 2440 through first reactor orifice 2447 is controlled by first vent valve 2470.

The pressure of excess first catalyst bed hydrogen and light end hydrocarbon gases, 2445, are monitored at first pressure controller 2450 which is above first catalyst bed 2460. If the pressure of first catalyst bed gases 2445 rises above the desired gas pressure, first pressure controller 2450 will signal to first hydrogen valve 2430 to decrease the amount of hydrogen to first mixer 2420. If the pressure of first catalyst bed gases 2445 drops below the desired gas pressure, first pressure controller 2450 will signal to first hydrogen valve 2430 to increase the amount of hydrogen into first mixer 2420.

First catalyst bed product 2446 exits first reactor 2440 through first reactor outlet 2444. First catalyst bed product 2446 flows into second mixer 2480 through third mixer inlet 2484 where it is combined with hydrogen 2492, which enters second mixer 2480 through fourth mixer inlet 2488. The quantity of hydrogen 2492 is controlled by second hydrogen valve 2490. First catalyst bed product/hydrogen 2482 exits second mixer 2480 through second mixer outlet 2486 and flows into second reactor 2500 through second reactor inlet 2502. Inside second reactor 2500, first catalyst bed product/hydrogen 2582 flows through second catalyst bed 2520 where it reacts. As first catalyst bed product/hydrogen 2482 reacts, second catalyst bed hydrogen gas and light end hydrocarbon gases 2505 may come out of solution and accumulate at the top of second reactor 2500. Second catalyst bed gases 2505 are removed from second reactor 2500 through second reactor orifice 2507. The rate at which second catalyst bed gases 2505 are removed from second reactor 2500 through second reactor orifice 2507 is controlled by second vent valve 2530.

The pressure of excess second catalyst bed hydrogen and light end hydrocarbon gases, 2505, are monitored at second pressure controller 2510 which is above second catalyst bed 2520. If the pressure of second catalyst bed gases 2505 rises above the desired gas pressure, second pressure controller 2510 will signal to second hydrogen valve 2490 to decrease the amount of hydrogen to second mixer 2480. If the pressure of second catalyst bed gases 2505 drops below the desired gas pressure, second pressure controller 2510 will signal to second hydrogen valve 2490 to increase the amount of hydrogen into second mixer 2480.

Reacted product 2506 exits second reactor 2500 through second reactor outlet 2504. Reacted product 2506 flows into second split area 2540 through fourth orifice 2542 where it is split into two flows, split reacted product 2552, which exits second split area 2540 through fifth orifice 2544, and recycled reacted product 2556 which exits second split area 2540 through sixth orifice 2546. Recycled reacted product 2556 is pumped through recycle pump 2560 before mixing with fresh feed 2402 at first split area 2410.

Figure 14:
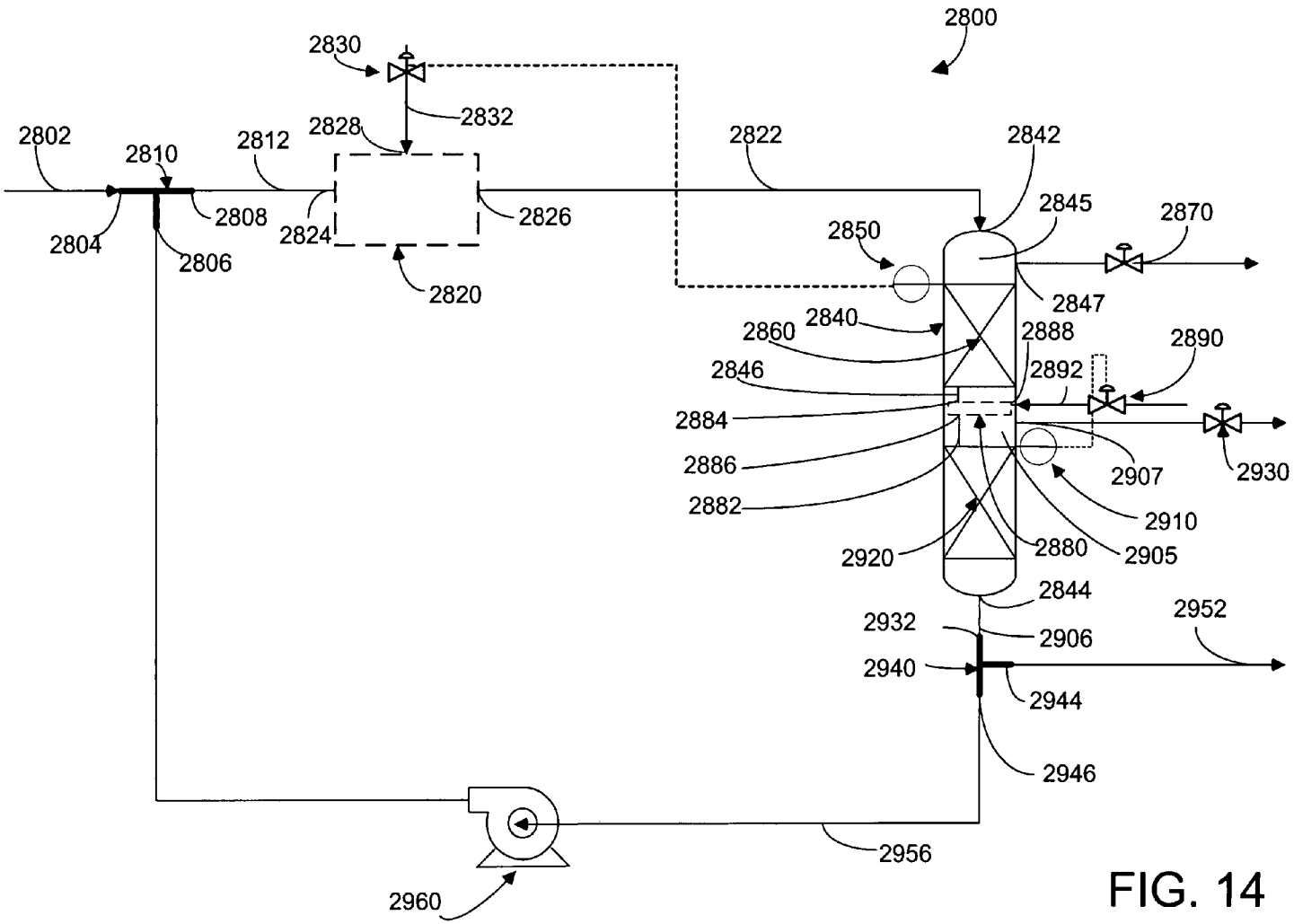
FIG. 14 is a schematic of a down flow single reactor system with two catalyst beds where the quantity of liquid in the reactor is controlled by the level of the liquid in the reactor.

FIG. 14 shows a schematic for a down flow multi-bed reactor system, generally designated by the numeral 2800 where the quantity of liquid in the reactor is controlled by the level of the liquid in the reactor. Fresh feed stock 2802 flows into first split area 2810 through first orifice 2804. Recycled reacted product 2956 flows into second orifice 2806 and the combined recycled reacted product and feed, 2812, exits first split area 2810 through third orifice 2808. Combined recycled reacted product and feed 2812 then enters first mixer 2820 through first mixer inlet 2824 where it is combined with hydrogen 2832, which enters first mixer 2820 through second mixer orifice 2828. The quantity of hydrogen 2832 is controlled by first hydrogen valve 2830. Recycled reacted product/feed/hydrogen 2822 exits first mixer 2820 through first mixer outlet 2826 and flows into reactor 2840 through reactor inlet 2842. Inside reactor 2840, recycled reacted product/feed/hydrogen 2822 flows through first catalyst bed 2860 where it reacts. As recycled reacted product/feed/hydrogen 2822 reacts, first catalyst bed hydrogen gas and light end hydrocarbon gases 2845 may come out of solution and accumulate at the top of reactor 2840. First catalyst bed gases 2845 are removed from reactor 2840 through first reactor orifice 2847. The rate at which first catalyst bed gases 2845 are removed from reactor 2840 through first reactor orifice 2847 is controlled by first vent valve 2870.

The level of the liquid recycled reacted product/feed/hydrogen 2822 is monitored at first level controller 2850 which is above first catalyst bed 2860. If the level of liquid recycled reacted product/feed/hydrogen 2822 rises above the desired liquid level, first level controller 2850 will signal to first hydrogen valve 2830 to increase the amount of hydrogen to first mixer 2820. If the level of liquid recycled reacted product/feed/hydrogen 2822 drops below the desired liquid level, first level controller 2850 will signal to first hydrogen valve 2830 to decrease the amount of hydrogen into mixer 2820.

First catalyst bed product 2846 flows into second mixer 2880 through third mixer inlet 2884 where it is combined with hydrogen 2892, which enters second mixer 2880 through fourth mixer inlet 2888. The quantity of hydrogen 2892 is controlled by second hydrogen valve 2890. First catalyst bed product/hydrogen 2882 exits second mixer 2880 through second mixer outlet 2886 and flows through second catalyst bed 2920 where it reacts. As first catalyst bed product/hydrogen 2882 reacts, second catalyst bed hydrogen gas and light end hydrocarbon gases 2905 may come out of solution and accumulate at the top of second catalyst bed 2920. Second catalyst bed gases 2905 are removed through second reactor orifice 2907. The rate at which second catalyst bed gases 2905 are removed from through second reactor orifice 2907 is controlled by second vent valve 2930.

The level of the liquid first catalyst bed product/hydrogen 2882 is monitored at second level controller 2910 which is above second catalyst bed 2920. If the level of liquid first catalyst bed product/hydrogen 2882 rises above the desired liquid level, second level controller 2910 will signal to second hydrogen valve 2890 to increase the amount of hydrogen to second mixer 2880. If the level of liquid first catalyst bed product/hydrogen 2882 drops below the desired liquid level, second level controller 2910 will signal to second hydrogen valve 2890 to increase the amount of hydrogen into second mixer 2880.

Reacted product 2906 exits reactor 2840 through reactor outlet 2844. Reacted product 2846 flows into second split area 2940 through fourth orifice 2942 where it is split into two flows, split reacted product 2952, which exits second split area 2940 through fifth orifice 2944, and recycled reacted product 2956 which exits second split area 2940 through sixth orifice 2946. Recycled reacted product 2956 is pumped through recycle pump 2960 before mixing with fresh feed 2802 at first split area 2810.

Figure 15:
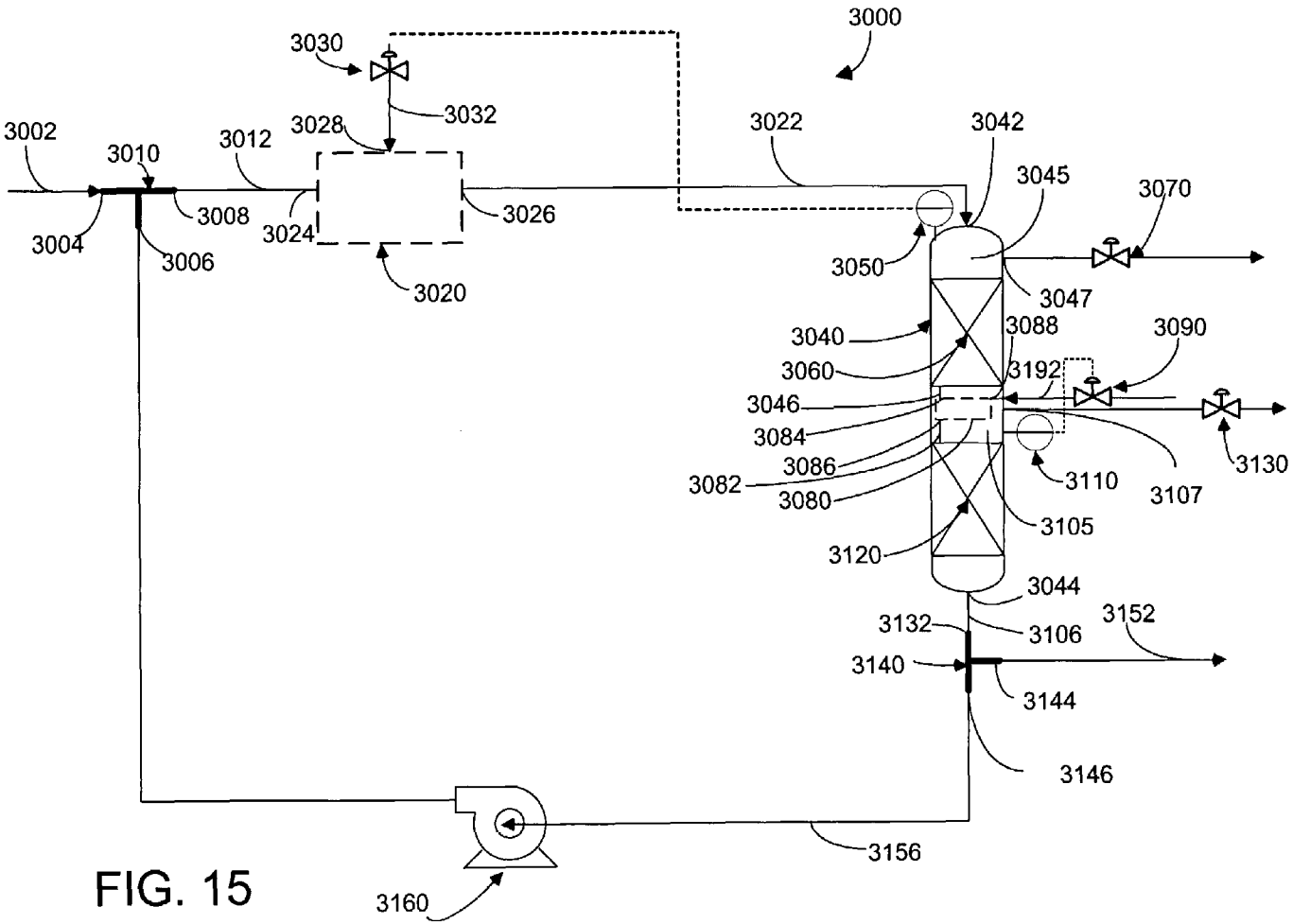
FIG. 15 is a schematic of a down flow single reactor system with two catalyst beds where the quantity of liquid in the reactor is controlled by the pressure of the gases in the reactor.

FIG. 15 shows a schematic for a down flow multi-bed reactor system, generally designated by the numeral 3000 where the quantity of liquid in the reactor is controlled by the pressure of the gases in the reactor. Fresh feed stock 3002 flows into first split area 3010 through first orifice 3004. Recycled reacted product 3156 flows into second orifice 3006 and the combined recycled reacted product and feed, 3012, exits first split area 3010 through third orifice 3008. Combined recycled reacted product and feed 3012 then enters first mixer 3020 through first mixer inlet 3024 where it is combined with hydrogen 3032, which enters first mixer 3020 through second mixer inlet 3028. The quantity of hydrogen 3032 is controlled by first hydrogen valve 3030. Recycled reacted product/feed/hydrogen 3022 exits first mixer 3020 through first mixer outlet 3026 and flows into reactor 3040 through reactor inlet 3042. Inside reactor 3040, recycled reacted product/feed/hydrogen 3022 flows through first catalyst bed 3060 where it reacts. As recycled reacted product/feed/hydrogen 3022 reacts, first catalyst bed hydrogen gas and light end hydrocarbon gases 3045 may come out of solution and accumulate at the top of reactor 3040. First catalyst bed gases 3045 are removed from reactor 3040 through first reactor orifice 3047. The rate at which first catalyst bed gases 3045 are removed from reactor 3040 through first orifice 3047 is controlled by first vent valve 3070.

The pressure of excess first catalyst bed hydrogen and light end hydrocarbon gases 3045 are monitored at first pressure controller 3050 which is above first catalyst bed 3060. If the pressure of first catalyst bed gases 3045 rises above the desired gas pressure, first pressure controller 3050 will signal to first hydrogen valve 3030 to decrease the amount of hydrogen to first mixer 3020. If the pressure of first catalyst bed gases 3045 drops below the desired gas pressure, first pressure controller 3050 will signal to first hydrogen valve 3030 to increase the amount of hydrogen into first mixer 3020.

First catalyst bed product 3046 flows into second mixer 3080 through third mixer inlet 3084 where it is combined with hydrogen 3092, which enters second mixer 3080 through fourth mixer inlet 3088. The quantity of hydrogen 3092 is controlled by second hydrogen valve 3090. First catalyst bed product/hydrogen 3082 exits second mixer 3080 through second mixer outlet 3086 and flows through second catalyst bed 3120 where it reacts. As first catalyst bed product/hydrogen 3082 reacts, second catalyst bed hydrogen gas and light end hydrocarbon gases 3105 may come out of solution and accumulate at the top of second catalyst bed 3120. Second catalyst bed gases 3105 are removed through second reactor orifice 3107. The rate at which second catalyst bed gases 3105 are removed from through second reactor orifice 3107 is controlled by second vent valve 3120.

The pressure of excess second catalyst bed hydrogen and light end hydrocarbon gases 3105 are monitored at second pressure controller 3110 which is above second catalyst bed 3120. If the pressure of second catalyst bed gases 3105 rises above the desired gas pressure, second pressure controller 3110 will signal to second hydrogen valve 3090 to decrease the amount of hydrogen to second mixer 3080. If the pressure of second catalyst bed gases 3105 drops below the desired gas pressure, second pressure controller 3110 will signal to second hydrogen valve 3090 to increase the amount of hydrogen into second mixer 3080.

Reacted product 3106 exits reactor 3040 through reactor outlet 3004. Reacted product 3106 flows into second split area 3140 through fourth orifice 3142 where it is split into two flows, split reacted product 3152, which exits second split area 3140 through fifth orifice 3144, and recycled reacted product 3156 which exits second split area 3140 through sixth orifice 3146. Recycled reacted product 3156 is pumped through recycle pump 3160 before mixing with fresh feed 3002 at first split area 3010.

Figure 16:
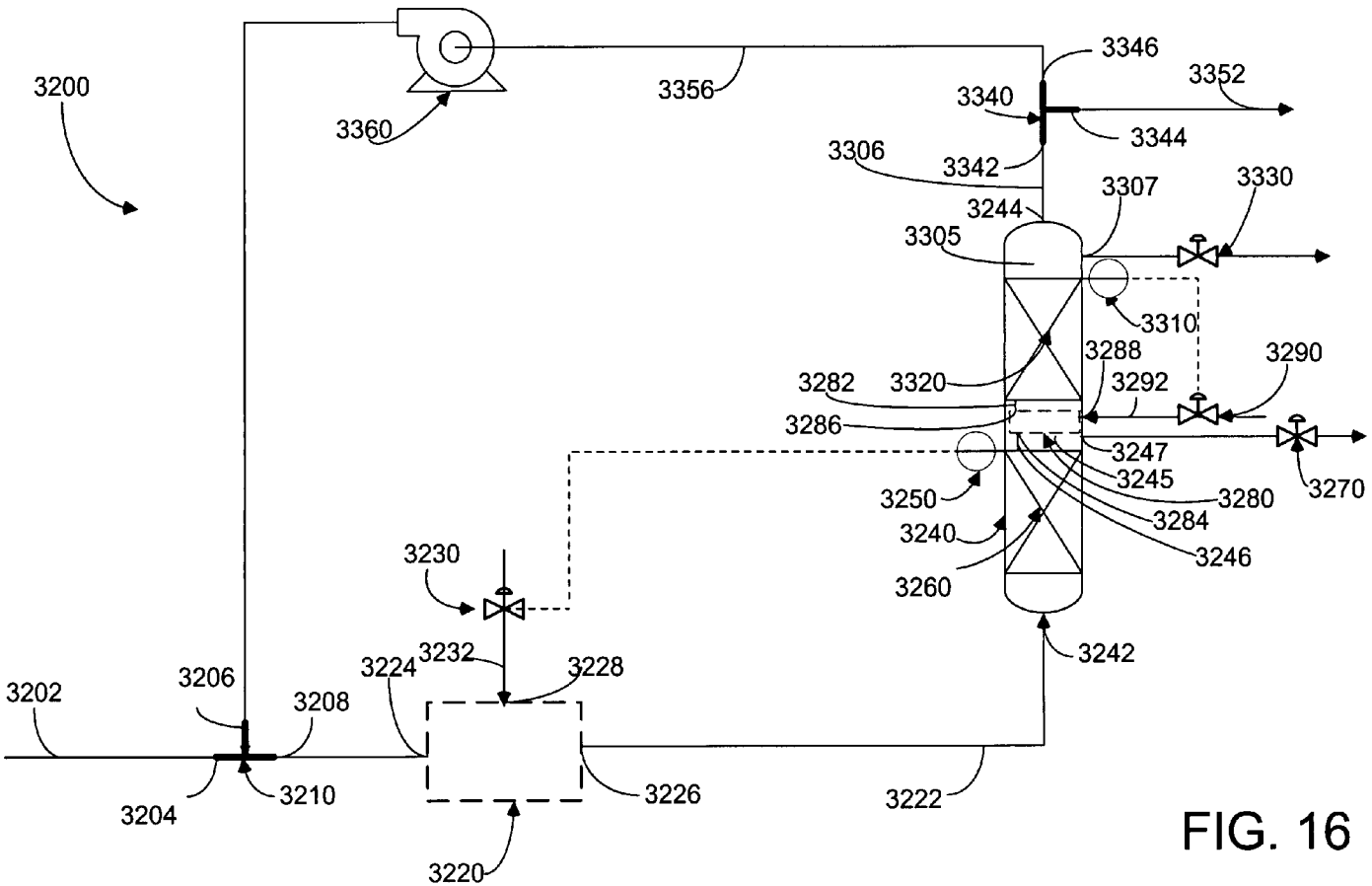
FIG. 16 is a schematic of an up flow single reactor system with two catalyst beds where the quantity of liquid in the reactor is controlled by the level of the liquid in the reactor.

FIG. 16 shows a schematic for an up flow multi-bed reactor system, generally designated by the numeral 3200 where the quantity of liquid in the reactor is controlled by the level of the liquid in the reactor. Fresh feed stock 3202 flows into first split area 3210 through first orifice 3204. Recycled reacted product 3356 flows into second orifice 3206 and the combined recycled reacted product and feed, 3212, exits first split area 3210 through third orifice 3208. Combined recycled reacted product and feed 3212 then enters first mixer 3220 through first mixer inlet 3224 where it is combined with hydrogen 3232, which enters first mixer 3220 through second mixer inlet 3228. The quantity of hydrogen 3232 is controlled by first hydrogen valve 3230. Recycled reacted product/feed/hydrogen 3222 exits first mixer 3220 through first mixer outlet 3226 and flows into reactor 3240 through reactor inlet 3242. Inside reactor 3240, recycled reacted product/feed/hydrogen 3222 flows through first catalyst bed 3260 where it reacts. As recycled reacted product/feed/hydrogen 3222 reacts, first catalyst bed hydrogen gas and light end hydrocarbon gases, 3245, may come out of solution and accumulate at the top of reactor 3240. First catalyst bed gases 3245 are removed from reactor 3240 through first reactor orifice 3247. The rate at which first catalyst bed gases 3245 are removed from reactor 3240 through first reactor orifice 3247 is controlled by first vent valve 3270.

The level of the liquid recycled reacted product/feed/hydrogen 3222 is monitored at first level controller 3250 which is above first catalyst bed 3260. If the level of liquid recycled reacted product/feed/hydrogen 3222 rises above the desired liquid level, first level controller 3250 will signal to first hydrogen valve 3230 to increase the amount of hydrogen to first mixer 3220. If the level of liquid recycled reacted product/feed/hydrogen 3222 drops below the desired liquid level, first level controller 3250 will signal to first hydrogen valve 3230 to decrease the amount of hydrogen into first mixer 3220.

First catalyst bed product 3246 flows into second mixer 3280 through third mixer inlet 3284 where it is combined with hydrogen 3292, which enters second mixer 3280 through fourth mixer inlet 3288. The quantity of hydrogen 3292 is controlled by second hydrogen valve 3290. First catalyst bed product/hydrogen 3282 exits second mixer 3280 through second mixer outlet 3286 and flows through second catalyst bed 3120 where it reacts. As first catalyst bed product/hydrogen 3282 reacts, second catalyst bed hydrogen gas and light end hydrocarbon gases 3305 may come out of solution and accumulate at the top of second catalyst bed 3320. Second catalyst bed gases 3305 are removed through second reactor orifice 3307. The rate at which second catalyst bed gases 3305 are removed from through second reactor orifice 3307 is controlled by second vent valve 3330.

The level of the first catalyst bed product/hydrogen 3282 is monitored at second level controller 3310 which is above second catalyst bed 3320. If the level of first catalyst bed product/hydrogen 3282 rises above the desired liquid level, second level controller 3310 will signal to second hydrogen valve 3290 to increase the amount of hydrogen to second mixer 3280. If the level of first catalyst bed product/hydrogen 3282 drops below the desired liquid level, second level controller 3310 will signal to second hydrogen valve 3290 to increase the amount of hydrogen into second mixer 3280.

Reacted product 3306 exits reactor 3240 through reactor outlet 3244. Reacted product 3246 flows into second split area 3340 through fourth orifice 3342 where it is split into two flows, split reacted product 3352, which exits second split area 3340 through fifth orifice 3344, and recycled reacted product 3356 which exits second split area 3340 through sixth orifice 3346. Recycled reacted product 3356 is pumped through recycle pump 3360 before mixing with fresh feed 3202 at first split area 3210.

Figure 17:
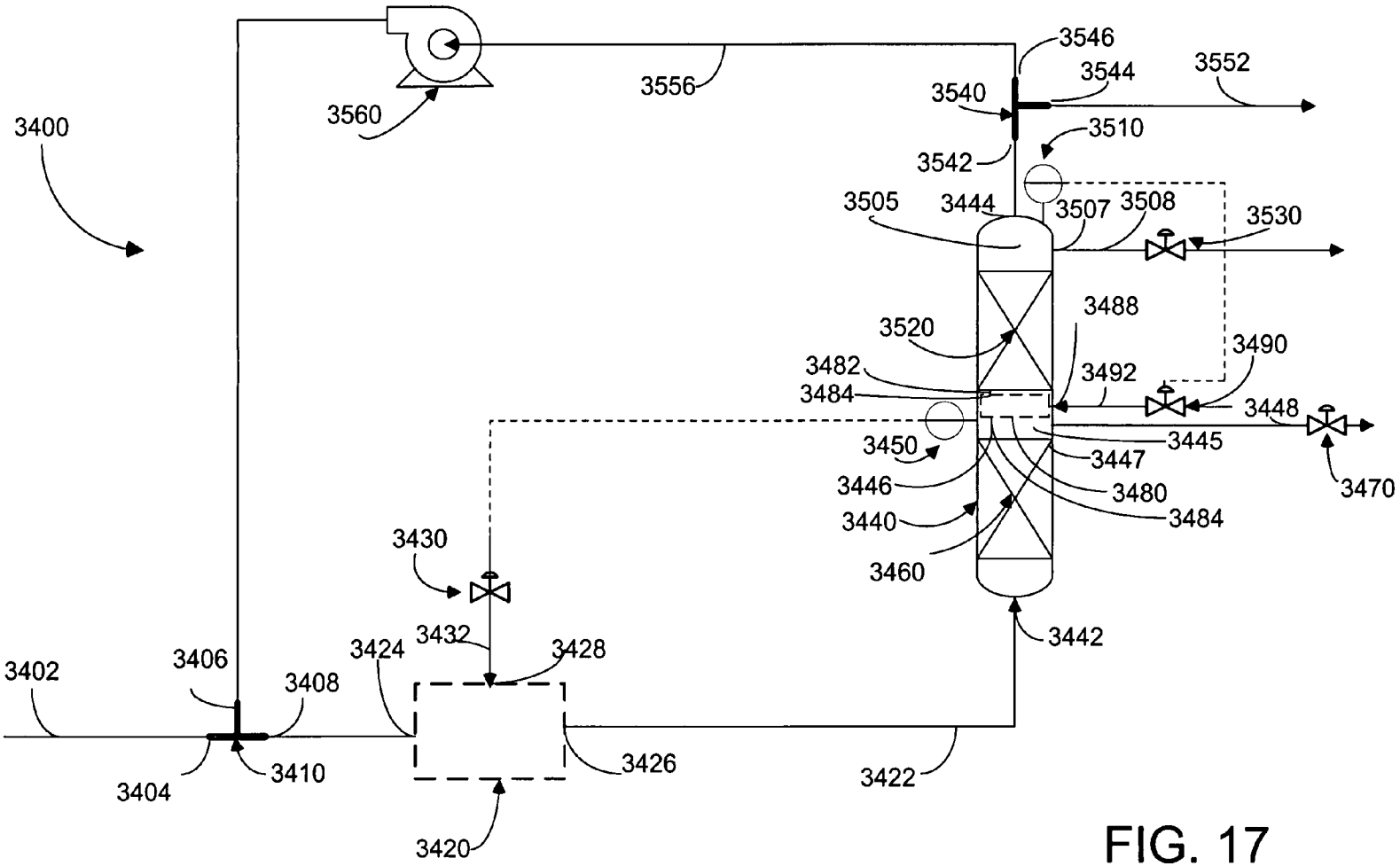
FIG. 17 is a schematic of an up flow single reactor system with two catalyst beds where the quantity of liquid in the reactor is controlled by the pressure of the gases in the reactor.

FIG. 17 shows a schematic for an up flow multi-bed reactor system, generally designated by the numeral 3400 where the quantity of liquid in the reactor is controlled by the pressure of the gases in the reactor. Fresh feed stock 3402 flows into first split area 3410 through first orifice 3404. Recycled reacted product 3556 flows into second orifice 3406 and the combined recycled reacted product and feed, 3412, exits first split area 3410 through third orifice 3408. Combined recycled reacted product and feed 3412 then enters first mixer 3420 through first mixer inlet 3424 where it is combined with hydrogen 3432, which enters first mixer 3420 through second mixer inlet 3428. The quantity of hydrogen 3432 is controlled by first hydrogen valve 3430. Recycled reacted product/feed/hydrogen 3422 exits first mixer 3420 through first mixer outlet 3426 and flows into reactor 3440 through reactor inlet 3442. Inside reactor 3440, recycled reacted product/feed/hydrogen 3422 flows through first catalyst bed 3460 where it reacts. As recycled reacted product/feed/hydrogen 3422 reacts, first catalyst bed hydrogen gas and light end hydrocarbon gases, 3445, may come out of solution and accumulate at the top of reactor 3440. First catalyst bed gases 3445 are removed from reactor 3440 through first reactor orifice 3447. The rate at which first catalyst bed gases 3445 are removed from reactor 3440 through orifice 3447 is controlled by first vent valve 3470.

The pressure of excess first catalyst bed hydrogen and light end hydrocarbon gases, 3445, are monitored at first pressure controller 3450 which is above first catalyst bed 3460. If the pressure of first catalyst bed gases 3445 rises above the desired gas pressure, first pressure controller 3450 will signal to first hydrogen valve 3430 to decrease the amount of hydrogen to first mixer 3420. If the pressure of first catalyst bed gases 3445 drops below the desired gas pressure, first pressure controller 3450 will signal to first hydrogen valve 3430 to increase the amount of hydrogen into first mixer 3420.

First catalyst bed product 3446 flows into second mixer 3480 through third mixer inlet 3484 where it is combined with hydrogen 3492, which enters second mixer 3480 through fourth mixer inlet 3488. The quantity of hydrogen 3492 is controlled by second hydrogen valve 3490. First catalyst bed product/hydrogen 3482 exits second mixer 3480 through second mixer outlet 3486 and flows through second catalyst bed 3520 where it reacts. As first catalyst bed product/hydrogen 3482 reacts, second catalyst bed hydrogen gas and light end hydrocarbon gases 3505 may come out of solution and accumulate at the top of second catalyst bed 3520. Second catalyst bed gases 3505 are removed through second reactor orifice 3507. The rate at which second catalyst bed gases 3505 are removed from through second reactor orifice 3507 is controlled by second vent valve 3530.

The pressure of excess second catalyst bed hydrogen and light end hydrocarbon gases, 3505, are monitored at second pressure controller 3510 which is above second catalyst bed 3520. If the pressure of second catalyst bed gases 3505 rises above the desired gas pressure, second pressure controller 3510 will signal to second hydrogen valve 3490 to decrease the amount of hydrogen to second mixer 3480. If the pressure of second catalyst bed gases 3505 drops below the desired gas pressure, second pressure controller 3510 will signal to second hydrogen valve 3490 to increase the amount of hydrogen into second mixer 3480.

Reacted product 3506 exits reactor 3440 through reactor outlet 3444. Reacted product 3446 flows into second split area 3540 through fourth orifice 3542 where it is split into two flows, split reacted product 3552, which exits second split area 3540 through fifth orifice 3544, and recycled reacted product 3556 which exits second split area 3540 through sixth orifice 3546. Recycled reacted product 3556 is pumped through recycle pump 3560 before mixing with fresh feed 3402 at first split area 3410.

FIG. 18 shows a schematic for a single bed reactor with a level controller for use in a down flow continuous liquid phase hydroprocessing process, generally designated by the number 4000. Reactor 4000 is composed of vessel 4010, having an inlet orifice, 4042, and an outlet orifice, 4044. The interior of reactor 4000 is divided into two zones, an upper zone, 4020, containing gases 4025, and a significantly larger lower zone, 4030, containing catalyst bed 4060, composed of catalyst particles 4062, and liquids 4035.

Level controller 4050 is used to maintain the quantity of liquids 4035 in lower zone 4030 at a level above catalyst bed 4060. Vent 4047 releases gases 4025 from upper zone 4020 at a predetermined constant rate. Vent 4047 is regulated by vent valve 4070.

Figure 19:
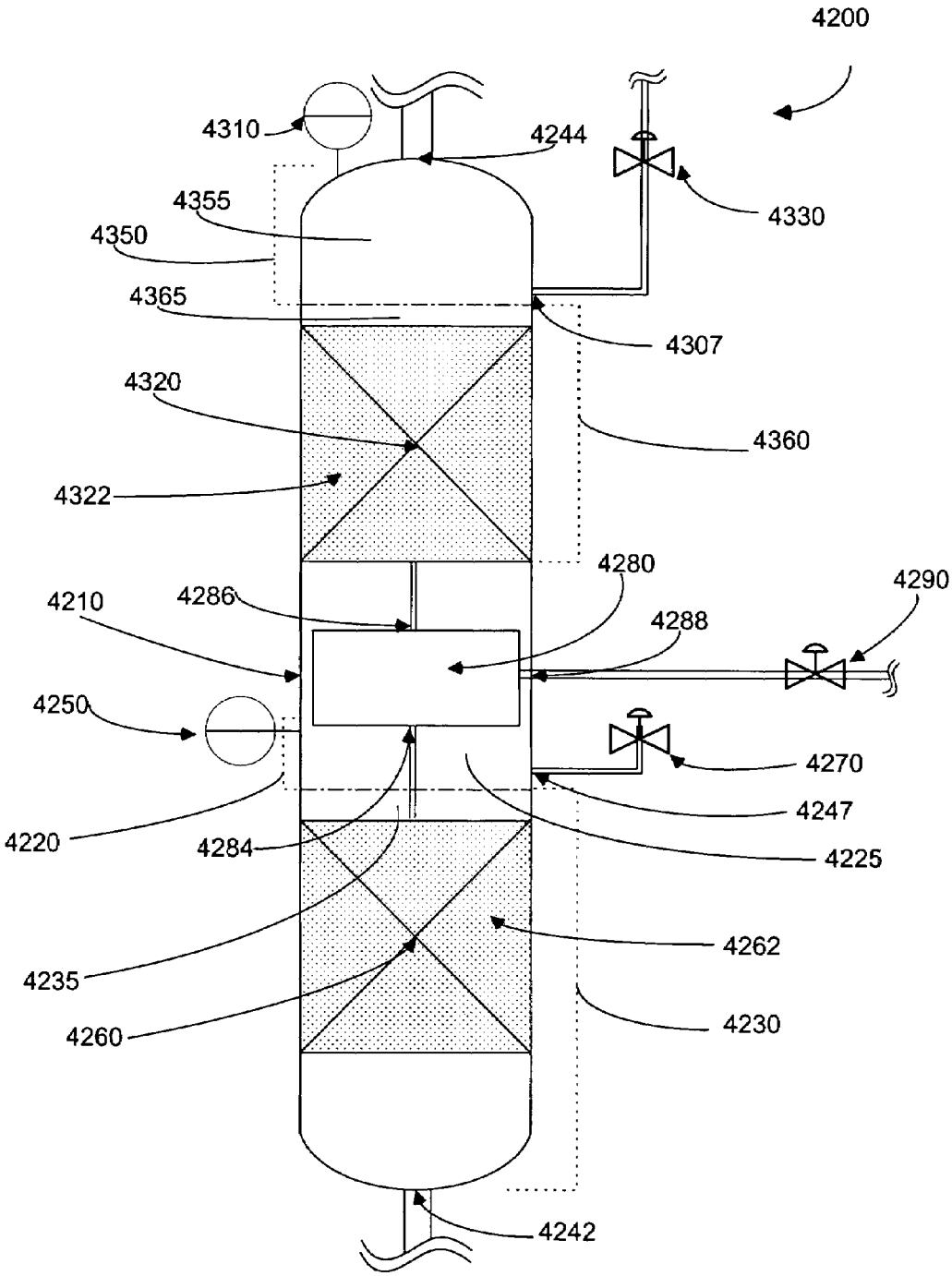
FIG. 19 is a schematic of a multi-bed, up flow reactor with two pressure controllers for use in a continuous liquid phase hydroprocessing process.

FIG. 19 shows a schematic for a multi-bed reactor with pressure controllers for use in an up flow continuous liquid phase hydroprocessing process, generally designated by the number 4200. Reactor 4200 is composed of vessel 4210, having an inlet orifice, 4242, and an outlet orifice, 4244. The interior of the reactor consists of a first catalyst bed, 4260, composed of catalyst particles 4262, followed by a mixer 4280, which is then followed by a second catalyst bed, 4320, composed of catalyst particles 4322.

The portion of reactor 4200 located between reactor inlet 4242 and mixer 4280 is divided into two zones, an upper zone, 4220, containing gases 4225, and a significantly larger lower zone, 4230, containing catalyst bed 4260 and liquids 4235.

Pressure controller 4250 is used to maintain the pressure of gases 4225 in upper zone 4220 at a predetermined pressure. Vent 4247 releases gases 4225 from upper zone 4220 at a predetermined constant rate. Vent 4247 is regulated by vent valve 4270.

Mixer 4280, comprising a first inlet 4284 to introduce liquids 4235 into mixer 4280, a second inlet 4288 to introduce hydrogen into mixer 4280, and an outlet 4286 leading to second catalyst bed 4320.

The portion of reactor 4200 located between mixer 4280 and reactor outlet 4244 is divided into two zones, an upper zone, 4350, containing gases 4355, and a significantly larger lower zone, 4360, containing catalyst bed 4320 and liquids 4365.

Pressure controller 4310 is used to maintain the pressure of gases 4355 in upper zone 4350 at a predetermined pressure. Vent 4307 releases gases 4355 from upper zone 4350 at a predetermined constant rate. Vent 4307 is regulated by vent valve 4330.

In accordance with the present invention, deasphalting solvents include propane, butanes, and/or pentanes. Other feed diluents include light hydrocarbons, light distillates, naphtha, diesel, VGO, previously hydroprocessed stocks, recycled hydrocracked product, isomerized product, recycled demetaled product, or the like.

EXAMPLE 1

A feed selected from the group of petroleum fractions, distillates, resids, waxes, lubes, DAO, or fuels other than diesel fuel is hydrotreated at 620K to remove sulfur and nitrogen. Approximately 200 SCF of hydrogen must be reacted per barrel of diesel fuel to make specification product. The diluent is selected from the group of propane, butane, pentane, light hydrocarbons, light distillates, naphtha, diesel, VGO, previously hydroprocessed stocks, or combinations thereof. A tubular reactor operating at 620K outlet temperature with a 1/1 or 2/1 recycle to feed ratio at 65 or 95 bar is sufficient to accomplish the desired reactions.

EXAMPLE 2

A feed selected from the group of petroleum fractions, distillates, resids, oils, waxes, lubes, DAO, or the like other than deasphalted oil is hydrotreated at 620K to remove sulfur and nitrogen and to saturate aromatics. Approximately 1000 SCF of hydrogen must be reacted per barrel of deasphalted oil to make specification product. The diluent is selected from the group of propane, butane, pentane, light hydrocarbons, light distillates, naphtha, diesel, VGO, previously hydroprocessed stocks, or combinations thereof. A tubular reactor operating at 620K outlet temperature and 80 bar with a recycle ratio of 2.5/1 is sufficient to provide all of the hydrogen required and allow for a less than 20K temperature rise through the reactor.

EXAMPLE 3

A continuous liquid phase hydroprocessing method and apparatus as described and show herein.

EXAMPLE 4

In a hydroprocessing method, the improvement comprising the step of mixing and/or flashing the hydrogen and the oil to be treated in the presence of a solvent or diluent in which the hydrogen solubility is high relative to the oil feed.

EXAMPLE 5

The Example 4 above wherein the solvent or diluent is selected from the group of heavy naphtha, propane, butane, pentane, light hydrocarbons, light distillates, naphtha, diesel, VGO, previously hydroprocessed stocks, or combinations thereof.

EXAMPLE 6

The Example 5 above wherein the feed is selected from the group of oil, petroleum fraction, distillate, resid, diesel fuel, deasphalted oil, waxes, lubes, and the like.

EXAMPLE 7

A continuous liquid phase hydroprocessing method comprising the steps of blending a feed with a diluent, saturating the diluent/feed mixture with hydrogen ahead of a reactor reacting the feed/diluent/hydrogen mixture with a catalyst in the reactor to saturate or remove sulfur, nitrogen, oxygen metals, or other contaminants, or for molecular weight reduction or cracking.

EXAMPLE 8

The Example 7 above wherein the reactor is kept at a pressure of 500-5000 psi, preferably 1000-3000 psi.

EXAMPLE 9

The Example 8 above further comprising the step of running the reactor at supercritical solution conditions so that there is no solubility limit.

EXAMPLE 10

The Example 9 above further comprising the step of removing heat from the reactor effluent, separating the diluent from the reacted feed, and recycling the diluent to a point upstream of the reactor.

EXAMPLE 11

A hydroprocessed, hydrotreated, hydrofinished, hydrorefined, hydrocracked, or the like petroleum product produced by one of the above described Examples.

EXAMPLE 12

A reactor vessel for use in the improved hydrotreating process of the present invention includes catalyst in relatively small tubes of 2-inch diameter, with an approximate reactor volume of 40 $ft^3$, and with the reactor built to withstand pressures of up to about only 3000 psi.

EXAMPLE 13

In a solvent deasphalting process eight volumes of n-butane are contacted with one volume of vacuum tower bottoms. After removing the pitch but prior to recovering the solvent from the deasphalted oil (DAO) the solvent/DAO mix is pumped to approximately 1000-1500 psi and mixed with hydrogen, approximately 900 SCF $H_2$ per barrel of DAO. The solvent/DAO/hydrogen mixture is heated to approximately 590K-620K and contacted with catalyst for removal of sulfur, nitrogen and saturation of aromatics. After hydrotreating the butane is recovered from the hydrotreated DAO by reducing the pressure to approximately 600 psi.

EXAMPLE 14

At least one of the examples above including multi-stage reactors, wherein two or more reactors are placed in series with the reactors configured in accordance with the present invention and having the reactors being the same or different with respect to temperature, pressure, catalyst, or the like, and/or multi-bed reactors, wherein two or more catalyst beds are placed in a single reactor in accordance with the present invention.

EXAMPLE 15

Further to Example 14 above, using multi-stage reactors to produce specialty products, waxes, lubes, and the like.

Briefly, hydrocracking is the breaking of carbon-carbon bonds and hydroisomerization is the rearrangement of carbon-carbon bonds. Hydrodemetalization is the removal of metals, usually from vacuum tower bottoms or deasphalted oil, to avoid catalyst poisoning in cat crackers and hydrocrackers.

EXAMPLE 16

Hydrocracking: A volume of vacuum gas oil is mixed with 1000 SCF $H_2$ per barrel of gas oil feed and blended with two volumes of recycled hydrocracked product (diluent) and passed over a hydrocracking catalyst at 750° F. and 2000 psi. The hydrocracked product contained 20 percent naphtha, 40 percent diesel and 40 percent resid.

EXAMPLE 17

Hydroisomerization: A volume of feed containing 80 percent paraffin wax is mixed with 200 SCF $H_2$ per barrel of feed and blended with one volume of isomerized product as diluent and passed over an isomerizing catalyst at 550° F. and 2000 psi. The isomerized product has a pour point of 30° F. and a VI of 140.

EXAMPLE 18

Hydrodemetalization: A volume of feed containing 80 ppm total metals is blended with 150 SCF $H_2$ per barrel and mixed with one volume of recycled demetaled product and passed over a catalyst of 450° F. and 1000 psi. The product contained 3 ppm total metals.

Generally, Fischer-Tropsch refers to the production of paraffins from carbon monoxide and hydrogen (CO and $H_2$ or synthesis gas). Synthesis gas contains $CO_2$, CO, $H_2$ and is produced from various sources, primarily coal or natural gas. The synthesis gas is then reacted over specific catalysts to produce specific products.

The Fischer-Tropsch synthesis is the production of hydrocarbons, almost exclusively paraffins, from CO and $H_2$ over a supported metal catalyst. The classic Fischer-Tropsch catalyst is iron; however other metal catalysts are also used.

Synthesis gas can and is used to produce other chemicals as well, primarily alcohols, although these are not Fischer-Tropsch reactions. The technology of the present invention can be used for any catalytic process where one or more components must be transferred from the gas phase to the liquid phase for reaction on the catalyst surface.

EXAMPLE 19

A two stage hydroprocessing method, wherein the first stage is operated at conditions sufficient for removal of sulfur, nitrogen, oxygen and the like (620K, 100 psi), after which the contaminants $H_2S$, $NH_3$ and water are removed and a second stage reactor is then operated at conditions sufficient for aromatic saturation.

EXAMPLE 20

The process as recited in at least one of the examples above, wherein in addition to hydrogen, carbon monoxide (CO) is mixed with the hydrogen and the mixture is contacted with a Fischer-Tropsch catalyst for the synthesis of hydrocarbon chemicals.

EXAMPLE 21

The process as recited in at least one of the examples above, wherein the quantity of the liquid feed/diluent/hydrogen mixture inside the reactor is controlled by the level of the liquid feed/diluent/hydrogen mixture and reacted liquid feed/diluent/hydrogen mixture in the reactor.

The level of the liquids in the reactor is held above the top of the catalyst bed in the reactor and monitored by a level controller. As the level of the liquids in the reactor rises or falls, the amount of hydrogen added to the feed/diluent mixture is adjusted to lower or raise, respectively, the level of the liquids in the reactor.

EXAMPLE 22

The process as recited in at least one of the examples above, wherein the quantity of the liquid feed/diluent/hydrogen mixture inside the reactor is controlled by the pressure of the excess hydrogen gas and light end hydrocarbon gases at the top of the reactor.

The pressure of the gases at the top of the reactor is held to a specified pressure appropriate for the particular application, with respect to the feed and the desired product specifications. As the pressure of the gases at the top of the reactor increases or decreases, the amount of hydrogen added to the feed/diluent mixture is adjusted to decrease or increase, respectively, the pressure of the gases at the top of the reactor.

In accordance with the present invention, an improved hydroprocessing, hydrotreating, hydrofinishing, hydrorefining, and/or hydrocracking process provides for the removal of impurities from lube oils and waxes at a relatively low pressure and with a minimum amount of catalyst by reducing or eliminating the need to force hydrogen into solution by pressure in the reactor vessel and by increasing the solubility for hydrogen by adding a diluent or a solvent or choice of diluent or solvent. For example, a diluent for a heavy cut is diesel fuel and a diluent for a light cut is pentane. Moreover, while using pentane as a diluent, one can achieve high solubility. Further, using the process of the present invention, one can achieve more than a stoichiometric requirement of hydrogen in solution. Also, by utilizing the process of the present invention, one can reduce cost of the pressure vessel and can use catalyst in small tubes in the reactor and thereby reduce cost. Further, by utilizing the process of the present invention, one may be able to eliminate the need for a hydrogen recycle compressor.

Although the process of the present invention can be utilized in conventional equipment for hydroprocessing, hydrotreating, hydrofinishing, hydrorefining and/or hydrocracking, one can achieve the same or a better result using lower cost equipment, reactors, hydrogen compressors, and the like by being able to run the process at a lower pressure, and/or recycling solvent, diluent, hydrogen, or at least a portion of the previously hydroprocessed stock or feed.

While the invention has been shown in only some of its forms, it should be apparent to those skilled in the art that it is not so limited, but is susceptible to various changes and modifications without departing from the scope of the invention. Accordingly, it is appropriate that the appended claims be construed broadly and in a manner consistent with the scope of the invention.

We claim:

1. A continuous liquid phase hydroprocessing method using a reactor at a predetermined temperature during steady state operation and having an upper zone of gases and a substantially larger lower zone of hydrogen dissolved in a mixture of liquids surrounding a catalyst, whereby said liquids minimize fluctuations in said predetermined temperature, compnsing:

(a) blending a liquid feed, having a contaminant or contaminants of at least one of sulfur, nitrogen, oxygen, metals, and combinations thereof, with a liquid diluent to form a continuous liquid phase diluent and feed mixture;

(b) blending said diluent and feed mixture with hydrogen, in a constant pressure environment, ahead of the reactor to form a continuous liquid phase feed, diluent and hydrogen mixture;

(c) introducing said continuous liquid phase feed, diluent and hydrogen mixture into the reactor;

(d) controlling the quantity of liquids in the reactor by monitoring said quantity of liquids and increasing or decreasing the quantity of hydrogen added in step b;

(e) venting excess gas from the reactor to facilitate controlling the quantity of liquids in the reactor; and (f) reacting the continuous liquid phase feed, diluent and hydrogen mixture at the active site of the catalyst in the reactor to remove the contaminant or contaminants from the feed mixture.

2. The method of claim 1 wherein:

the method of controlling the quantity of liquid in the reactor is based on the level of said liquid inside the reactor.

3. The method of claim 1 wherein:

the method of controlling said quantity of liquid in the reactor is based on the pressure of the gases inside the reactor.

4. The method of claim 1 wherein:

the feed, diluent and hydrogen mixture feeds into the top of the reactor.

5. The method of claim 1 wherein:

the feed, diluent and hydrogen mixture feeds into the bottom of the reactor.

6. The method as in claim 1 wherein:

the vent rate is set to control the buildup of light ends in the system.

7. The method of claim 1 wherein:

the solvent or diluent is selected from the group of heavy naphtha, propane, butane, pentane, light hydrocarbons, light distillates, naphtha, diesel, VGO, previously hydroprocessed stocks, or combinations thereof.

8. The method of claim 1 wherein:

the feed is selected from the group of oil, petroleum fraction, distillate, resid, diesel fuel, deasphalted oil, waxes, lubes, and specialty products.

9. The method of claim 1 wherein:

the catalyst is selected from the group of catalyst particles that are spherical, cylindrical, trilobe, quadralobe, or combinations or variants thereof.

10. The method of claim 1 wherein:

the method is a multi-stage process using a series of two or more reactors.

11. The method of claim 1 wherein:

multiple reactors, or multiple bed reactors, are used to remove at least one of sulfur, nitrogen, oxygen, metals, and combinations thereof, saturate aromatics, or reduce molecular weight.

12. The method of claim 1 wherein:

the liquids surrounding said catalyst are substantially isothermal.

13. The method of claim 1 wherein:

said step of monitoring said quantity of liquids includes means for monitoring the level of said liquids in the lower zone of the reactor.

14. The method of claim 1 wherein:

said step of monitoring said quantity of liquids includes means for monitoring the pressure of said gases in the upper zone of the reactor.

15. The method of claim 1 wherein:

the temperature of the liquid in the reactor is maintained by controlling one or both of the temperature of said liquid feed and said liquid diluent.

16. A continuous liquid phase hydroprocessing method using a reactor at a predetermined temperature during steady state operation and having an upper zone of gases and a substantially larger lower zone of hydrogen dissolved in a mixture of liquids surrounding a catalyst, whereby said liquids minimize fluctuations in said predetermined temperature, comprising:

(a) blending a liquid feed, having a contaminant or contaminants of at least one of sulfur, nitrogen, oxygen, metals, and combinations thereof, with a liquid diluent to form a continuous liquid phase diluent and feed mixture;

(b) blending said diluent and feed mixture with hydrogen, in a constant pressure environment, ahead of the reactor to form a continuous liquid phase feed, diluent and hydrogen mixture;

(c) introducing said continuous liquid phase feed, and diluent and hydrogen mixture into the reactor ;

(d) controlling the pressure of said gases in the reactor by monitoring said gas pressure and increasing or decreasing the quantity of hydrogen added in step b;

(e) venting excess gas from the reactor to facilitate controlling the quantity of liquids in the reactor; and (f) reacting the continuous liquid phase feed, diluent and hydrogen mixture at the active site of the catalyst in the reactor to remove the contaminant or contaminants from the feed mixture to form reacted liquid.

17. The method of claim 16 wherein:

the feed, diluent and hydrogen mixture feeds into the top of the reactor.

18. The method of claim 16 wherein:

the feed, diluent and hydrogen mixture feeds into the bottom of the reactor.

19. The method as in claim 16 wherein:

the vent rate is set to control the buildup of light ends in the system.

20. The method of claim 16 wherein:

the solvent or diluent is selected from the group of heavy naphtha, propane, butane, pentane, light hydrocarbons, light distillates, naphtha, diesel, VGO, previously hydroprocessed stocks, or combinations thereof.

21. The method of claim 16 wherein:

the feed is selected from the group of oil, petroleum fraction, distillate, resid, diesel fuel, deasphalted oil, waxes, lubes, and specialty products.

22. The method of claim 16 wherein:

the catalyst is selected from the group of catalyst particles that are spherical, cylindrical, trilobe, quadralobe, or combinations or variants thereof.

23. The method of claim 16 wherein:

the method is a multi-stage process using a series of two or more reactors.

24. The method of claim 16 wherein:

multiple reactors, or multiple bed reactors, are used to at least one of remove sulfur, nitrogen, oxygen, metals, and combinations thereof, saturate aromatics, or reduce molecular weight.

25. The method of claim 16 wherein:

the liquids surrounding said catalyst are substantially isothermal.

26. The method of claim 16 wherein:

said step of monitoring said gas pressure includes means for monitoring the pressure of said gases in the upper zone of the reactor.

27. The method of claim 16 wherein:

the temperature of the liquid in the reactor is maintained by controlling one or both of the temperature of said liquid feed and said liquid diluent.

28. The method of claim 1, wherein:

said step of monitoring said gas pressure includes means for monitoring the pressure of said gases in the upper zone of the reactor.

29. The method of claim 4, wherein:

venting excess gas from the reactor comprises venting excess gas from the top of the reactor.

30. The method of claim 17, wherein:

venting excess gas from the reactor comprises venting excess gas from the top of the reactor.

31. The method of claim 1, wherein:

venting excess gas from the reactor comprises continuously venting excess gas from the reactor.

32. The method of claim 16, wherein:

venting excess gas from the reactor comprises continuously venting excess gas from the reactor.

* * * * *